United States Patent [19]

Hess et al.

[11] Patent Number: 4,478,928

[45] Date of Patent: Oct. 23, 1984

[54] APPLICATION OF ACTIVATED ARYLHYDRAZIDES TO SILVER HALIDE PHOTOGRAPHY

[75] Inventors: Thomas C. Hess; Karl E. Wiegers, both of Rochester, N.Y.

[73] Assignee: Eastman Kodak Company, Rochester, N.Y.

[21] Appl. No.: 493,480

[22] Filed: May 11, 1983

[51] Int. Cl.[3] ..... G03C 1/28; G03C 1/36

[52] U.S. Cl. ..... 430/217; 430/599; 430/600; 430/603; 430/598; 430/614

[58] Field of Search ..... 430/599, 603, 598, 217, 430/600, 614

[56] References Cited

U.S. PATENT DOCUMENTS

| | | |
|---|---|---|
| 2,419,975 | 5/1947 | Trivelli et al. . |
| 2,563,785 | 8/1951 | Ives . |
| 3,227,552 | 1/1966 | Whitmore . |
| 3,615,615 | 10/1971 | Lincoln et al. . |
| 3,854,956 | 12/1974 | Lincoln et al. . |
| 4,030,925 | 6/1977 | Leone et al. . |
| 4,031,127 | 6/1977 | Leone et al. . |
| 4,080,207 | 3/1978 | Leone et al. . |
| 4,139,387 | 2/1979 | Von Konig et al. . |
| 4,168,977 | 9/1979 | Takada et al. . |
| 4,224,401 | 9/1980 | Takada et al. . |
| 4,243,739 | 1/1981 | Mifune et al. . |
| 4,245,037 | 1/1981 | Tsujino et al. . |
| 4,255,511 | 3/1981 | Hirano et al. . |
| 4,266,013 | 5/1981 | Adachi et al. . |
| 4,269,929 | 5/1981 | Nothnagle . |
| 4,272,614 | 6/1981 | Mifune et al. . |
| 4,276,364 | 6/1981 | Leone . |
| 4,294,919 | 10/1981 | Tsujino et al. . |
| 4,323,643 | 4/1982 | Mifune et al. . |

FOREIGN PATENT DOCUMENTS

| | | |
|---|---|---|
| 2089057A | 6/1982 | United Kingdom . |
| 2097140A | 10/1982 | United Kingdom . |

OTHER PUBLICATIONS

*Research Disclosure,* vol. 151, Nov. 1976, Item 15162.

*Research Disclosure,* vol. 176, Dec. 1978, Item 17626.

Borsche and Ockinga, "Regarding the Relationships Between Quinone Hydrazines and p-Oxyazo Compounds", *Annalen der Chemie,* vol. 340, 1905, pp. 85-101.

Hantzsch and Glogauer, "Regarding the Addition Products of Azo and Diazo Elements with Benzenesulfinic Acid", *Berichte der Deutschen Chemischen Gesellschaft,* vol. I, 1897, pp. 2548-2559.

*Primary Examiner*—Won H. Louie

*Attorney, Agent, or Firm*—Carl O. Thomas

[57] ABSTRACT

The use of sulfinic acid radical substituted arylhydrazides in producing images in silver halide photographic elements is disclosed. The sulfinic acid radical substituted arylhydrazide can be incorporated in photographic silver halide, emulsions, and photographic elements. The sulfinic acid radical substituent is capable of activating the arylhydrazides, particularly for use at a lower alkaline pH. In negative working surface latent image forming emulsions the sulfinic acid radical substituted arylhydrazides permit higher speed or contrast to be achieved. In direct positive internal latent image forming emulsions increased nucleation activity and reduced rereversal can be achieved.

34 Claims, 2 Drawing Figures

APPLICATION OF ACTIVATED ARYLHYDRAZIDES TO SILVER HALIDE PHOTOGRAPHY

FIELD OF THE INVENTION

This invention is directed to silver halide emulsions and photographic elements. The invention is applicable to negative working surface latent image forming silver halide emulsions and to direct positive silver halide emulsions which form internal latent images.

BACKGROUND OF THE INVENTION

Hydrazines find a variety of uses in silver halide photography. They have been used in negative working surface latent image forming silver halide emulsions to increase speed and/or contrast. They have been used in direct positive internal latent image forming emulsions as nucleating agents.

The use of hydrazines in negative working surface latent image forming emulsions to increase speed and contrast is taught by Trivelli et al U.S. Pat. No. 2,419,975. Increased contrast attributable to hydrazines in negative working surface latent image forming emulsions is believed to result from the promotion of infectious development.

Direct positive images can be produced using internal latent image forming emulsions by uniformly exposing the emulsions to light during development. This renders selectively developable the emulsion grains which were not imagewise exposed—that is, those grains which do not contain an internal latent image. Ives U.S. Pat. No. 2,563,785 recognized that the presence of hydrazines during processing can obviate the need for uniform light exposure. Hydrazines so employed with direct positive internal latent image forming emulsions are commonly referred to as nucleating agents. Occasionally the term "fogging agent" is employed, but the term "nucleating agent" is preferred, since nucleating agents do not produce indiscriminate fogging.

The most efficient hydrazines employed in silver halide photographic systems employ a combination of substituents to balance activity and stability. The stability of hydrazines is increased by attaching directly to one of the nitrogen atoms a tertiary carbon atom, such as the carbon atom of an aromatic ring. The art has long recognized that the activity of these stabilized hydrazines can be increased by the direct attachment of an acyl group to the remaining nitrogen atom. Thus, the most commonly employed hydrazines are arylhydrazides.

The following are illustrative of specific arylhydrazides employed with negative working surface latent image forming silver halide emulsions primarily to increase contrast:

| | |
|---|---|
| P-1 Takada et al | U.S. Pat. No. 4,168,977 |
| P-2 Takada et al | U.S. Pat. No. 4,224,401 |
| P-3 Mifune et al | U.S. Pat. No. 4,243,739 |
| P-4 Mifune et al | U.S. Pat. No. 4,272,614 |
| P-5 Mifune et al | U.S. Pat. No. 4,323,643 |

The arylhydrazide can be incorporated directly in a photographic element or in a processing solution for the element. A preferred processing solution is disclosed in the following patent:

| | |
|---|---|
| P-6 Nothnagle | U.S. Pat. No. 4,269,929. |

The following are illustrative of specific acylhyrazides employed with direct positive internal latent image forming emulsions to act as nucleating agents:

| | | |
|---|---|---|
| P-7 | Whitmore | U.S. Pat. No. 3,227,552 |
| P-8 | Leone 10024. al | U.S. Pat. No. 4,030,925 |
| P-9 | Leone et al | U.S. Pat. No. 4,031,127 |
| P-10 | Leone et al | U.S. Pat. No. 4,080,207 |
| P-11 | Tsujino et al | U.S. Pat. No. 4,245,037 |
| P-12 | Hirano et al | U.S. Pat. No. 4,255,511 |
| P-13 | Adachi et al | U.S. Pat. No. 4,266,013 |
| P-14 | Leone | U.S. Pat. No. 4,276,364 |
| P-15 | Hirano et al | U.K. Pat. App. 2,087,057A |

RD-1 Research Disclosure, Vol. 151, November 1976, Item 15162. (Note also reduction sensitization effect, left column, page 77.)

RD-2 Sidhu et al Research Disclosure, Vol. 176, December 1978, Item 17626 December 1978, Item 17626 (Research Disclosure and Product Licensing Index were publications of Industrial Opportunities Ltd.; Homewell, Havant; Hampshire, P09 1EF, United Kingdom Research Disclosure is now published at Emsworth Studios, 535 West End Avenue, New York, New York 10024.)

For the most part these nucleating agents contain a moiety for promoting adsorption to the silver halide grain surfaces and are therefore preferably incorporated directly within the silver halide emulsion. Unadsorbed nucleating agents, such as those disclosed by P-7, for example, can be present in other photographic element layers or in processing solutions, if desired. Unadsorbed nucleating agents incorporated in photographic elements are often ballasted.

The above arylhydrazide nucleating agents share a common characteristic in that one hydrogen is attached to each of the $\alpha$ and $\beta$ nitrogen atoms. Tsujino et al U.S. Pat. No. 4,294,919 differs from the above patents in adding in one optional form a second hydrazino moiety which can be fully substituted; however, the $\alpha$ and $\beta$ nitrogen atoms attached to the acyl moiety each require one hydrogen. Von Konig et al U.S. Pat. No. 4,139,387 discloses a sulfocarbazide used as a nucleating agent. As generically disclosed both an acyl moiety and another moiety can be attached to a single nitrogen atom. No specific illustration is provided.

Borsche and Ockinga "Regarding the Relationships Between Quinone Hydrazones and p-Oxyazo Compounds", *Annalen der Chemie,* Vol. 340, 1905, pp. 85–101, describes the preparation of arylhydrazines and their derivatives, including 1-benzoyl-2-phenylsulfonyl-2-(4-hydroxyphenyl) hydrazide. Hantzsch and Glogauer "Regarding the Addition Products of Azo and Diazo Elements with Benzenesulfinic Acid", *Berichte der Deutschen Chemischen Gesellschaft,* Vol. I, 1897, pp. 2548–2559, discloses the preparation of 1-carbamoyl-2-phenyl-2-phenylsulfonylhydrazine.

Lincoln and Heseltine U.S. Pat. Nos. 3,615,615 and 3,854,956 disclose heterocyclic nuclei of the type found in cyanine dyes substituted at the quaternized nitrogen atom with an arylsulfohydrazonoalkyl substituent. These compounds are disclosed to be useful as nucleating agents in direct positive internal latent image forming silver halide emulsions.

Takahashi et al U.K. Pat. App. No. 2,097,140A discloses a coupler containing at the coupling site a development accelerating group preferably of the formula:

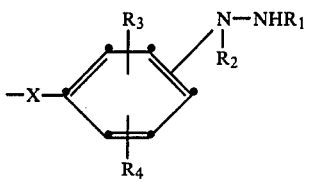

wherein $R_1$, is formyl, acyl, sulfonyl, alkoxycarbonyl, carbamoyl or sulfamoyl, $R_2$ is H, acetyl, ethoxycarbonyl, or methanesulfonyl, $R_3$ and $R_4$ are each H, halogen, or $C_{1-4}$ alkyl or alkoxy, and X a linking group containing a hetero atom and can comprise a heterocyclic ring linked to the residue by the hetero atom.

SUMMARY OF THE INVENTION

Figure 1:
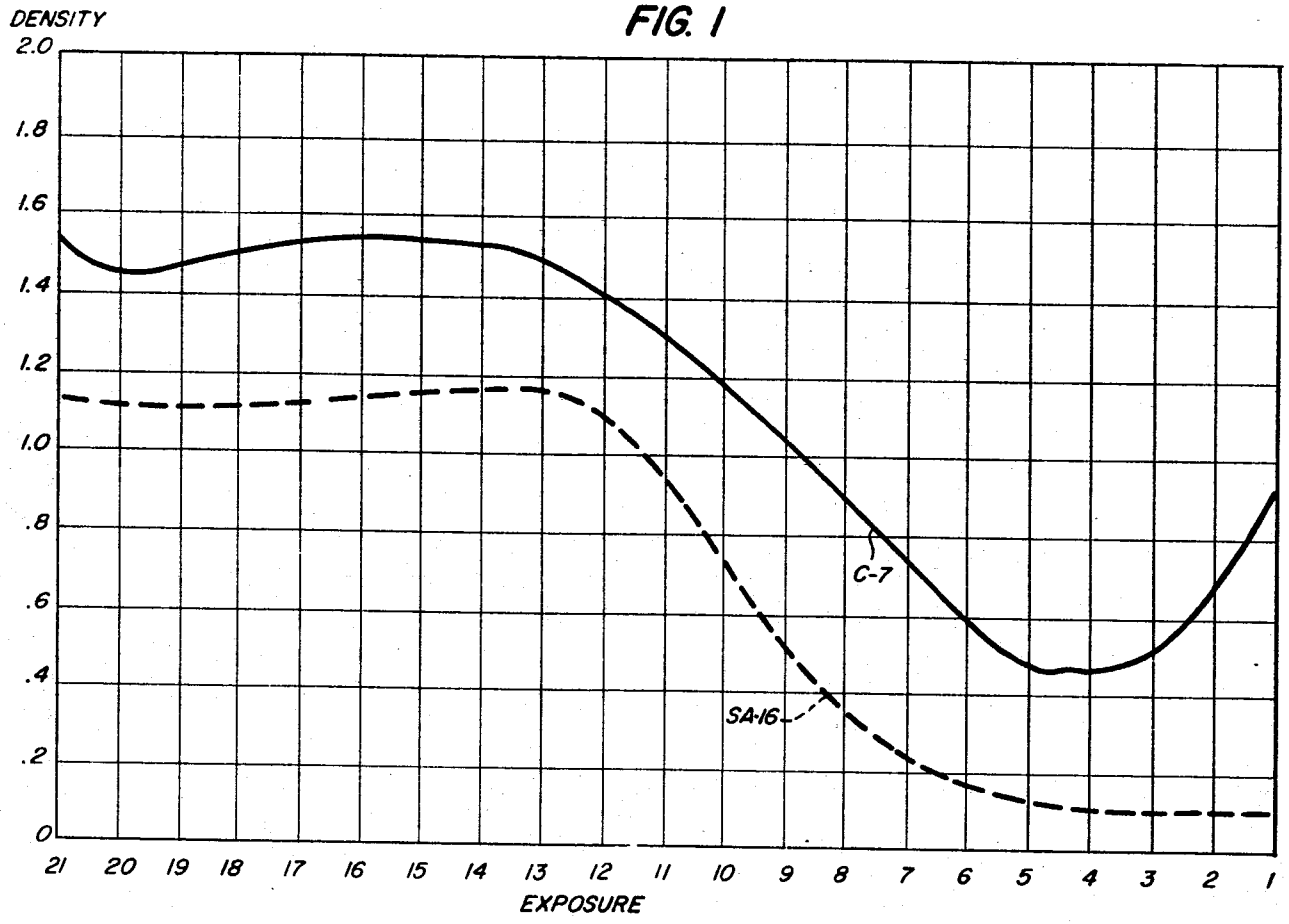
FIGS. 1 and 2 are plots of density versus exposure.

The present invention relates to an improvement in silver halide photography as it relates to radiation sensitive silver halide emulsions, photographic elements containing these emulsions, and processes for their development employing at least one arylhydrazide. Specifically, it is the recognition of this invention that the activity of arylhydrazides is increased when one of the $\alpha$ and $\beta$ nitrogen atoms is sulfinic acid radical substituted and the remaining of these two nitrogen atoms is provided with a hydrogen atom bonded thereto.

It appears that these sulfinic acid radical substituted arylhydrazides are useful over a broad range of development pH levels. Useful levels of activity have been observed from pH levels below 10.0 to pH levels above 13.0. They show particularly increased activity over comparable arylhydrazides lacking the requisite $\alpha$ and $\beta$ nitrogen atom pendant moiety at lower alkaline pH levels.

When employed with negative working surface latent image forming silver halide emulsions, these sulfinic acid radical substituted arylhydrazides can show increased speed and/or contrast, depending upon the specific photographic system chosen.

When employed with direct positive internal latent image forming silver halide emulsions, these sulfinic acid radical substituted arylhydrazides show increased nucleating activity. They can also reduce rereversal of these emulsions.

This invention is directed to a radiation sensitive photographic silver halide emulsion containing an arylhydrazide comprised of aryl and acyl groups linked by a divalent hydrazino moiety having one of its nitrogen atoms sulfinic acid radical substituted and a hydrogen atom bonded to the other of its nitrogen atoms.

This invention is directed additionally to silver halide photographic elements containing these emulsions and to processes for processing a viewable image by developing these photographic elements when imagewise exposed.

DESCRIPTION OF PREFERRED EMBODIMENTS

The arylhydrazides contemplated for use in the practice of this invention are those which contain aryl and acyl groups linked by a divalent hydrazino moiety having its nitrogen atom in the $\alpha$ or $\beta$ position, with respect to the acyl group, sulfinic acid radical substituted and a hydrogen atom bonded to the remaining of these two nitrogen atoms. The requisite arylhydrazide structure can be represented by the following:

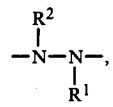

(I)

wherein $R^1$ can be either hydrogen or a sulfinic acid radical substituent and $R^2$ is chosen to be a sulfinic acid radical substituent when $R^1$ is hydrogen and hydrogen when $R^1$ is a sulfinic acid radical.

The arylhydrazides having a combination of a hydrogen atom and a sulfinic acid radical substituent attached to the $\alpha$ and $\beta$ nitrogen atoms exhibit high levels of activity as compared to corresponding arylhydrazides having instead pendant hydrogen atoms on both these nitrogen atoms. This is contrary to the typical observation of degradation or even effective elimination of activity when either or both of the $\alpha$ and $\beta$ nitrogen atoms of arylhydrazides are fully substituted.

Although not capable of direct observation, it is believed that conventional arylhydrazides are active because of their ability to eliminate hydrogen, thereby assuming the following interim structural form:

(II)

Whereas conventional $\alpha$ and $\beta$ nitrogen atom substituents interfere with achieving this interim structural form, it is believed that the pendant hydrogen and sulfinic acid radical substituent together are capable of facilitating transition from structural form I above to structural form II. Specifically, it is believed that a propensity of $R^1$ and $R^2$ to react to produce a sulfinic acid facilitates their elimination and activates the arylhydrazide in its transition to interim form II. The present invention is thus believed to be the first in which an arylhydrazide is activated by a choice of $\alpha$ and $\beta$ nitrogen atom pendant moieties that are interactive in facilitating their elimination. Thus, although $R^1$ and $R^2$ are shown to be a combination of hydrogen and a sulfinic acid radical substituent, it is appreciated that other, equivalent values of $R^1$ and $R^2$ are possible and specifically contemplated.

The arylhydrazide structure can be represented by the following formula:

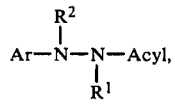

(III)

wherein

Acyl is an acyl group;

Ar is an aryl group; and $R^1$, which is attached to the nitrogen atom $\alpha$ to the acyl moiety; and $R^2$, which is attached to the nitrogen atom $\beta$ to the acyl moiety, are as previously defined.

Acyl and Ar can be chosen from among acyl and aryl groups, such as those found in conventional arylhydrazides employed as photographic element or processing solution addenda, such as those of patents P-1 through P-15, RRD-1, and RD-2, listed above, here incorporated by reference.

The term "acyl" is defined as the group formed by the removal of a hydroxy moiety directly bonded to a carbonyl moiety of a carboxy group. In a preferred form Acyl can be represented by the following formula:

$$-\overset{\overset{\displaystyle O}{\|}}{C}-R^3, \qquad \text{(IV)}$$

where $R^3$ is hydrogen, amino, an alkyl or alkoxy substituent, or an aryl substituent. A particularly preferred acyl group is formyl, in which instance $R^3$ is hydrogen. Specifically preferred alkyl and alkoxy substituents are alkyl and alkoxy (unsubstituted), most preferably those of from about 1 to 8 carbon atoms, optimally 1 to 4 carbon atoms. Specifically preferred aryl substituents are phenyl and naphthyl. Either electron withdrawing or electron donating substituents of the aromatic ring or alkyl moieties are contemplated with the former being preferred. Highly electron donating substituents can reduce activity. Alkyl, alkoxy, carboxy, cyano, nitro, halo, or haloalkyl substituents to the aromatic ring or alkyl moieties are specifically contemplated. The acyl group preferably contains less than 10, most preferably less than 8, carbon atoms.

The term "aryl" is defined as the organic radical formed by the removal of one pendant atom directly bonded to a ring carbon atom of an aromatic nucleus. The aromatic nucleus can be comprised of a carbocyclic aromatic ring, such as a separate or fused benzene ring (e.g., a phenyl or naphthyl ring), or a heterocyclic ring of significant aromaticity (e.g., a pyridyl, pyrolyl, furyl, or thiyl ring). The aromatic nucleus can include ring substituents.

The aryl group Ar is preferably phenyl or naphthyl. The phenyl or naphthyl group can be unsubstituted or substituted. Either electron donating or electron withdrawing substituents of the aromatic ring are contemplated, with the former being preferred. Highly electron withdrawing substituents, such as cyano, have been observed to reduce activity. Examples of useful substituents include hydroxy, amino, carboxy, alkyl, alkoxy, halo, and haloalkyl. As herein defined cycloalkyl is subsumed within alkyl moieties. The amino substituents include primary, secondary, and tertiary amino groups. Substituents other than ballasting groups, discussed below, typically contain up to about 8 carbon atoms.

The term "sulfinic acid radical" is herein defined as the radical produced by the removal of the acid hydrogen ion from a sulfinic acid. Thus, the sulfinic acid radical can be produced from any conventional sulfinic acid. The sulfonyl group of the sulfinic acid can be bonded directly to either an aliphatic or aromatic residue. The aliphatic residue can, for example, be an alkyl substituent. A simple alkyl subsitutent can take the form of alkyl of from 1 to 8 carbon atoms, most typically 1 to 3 carbon atoms. In a preferred form the sulfinic acid radical includes an aromatic residue. A preferred substituent can be represented by the following:

$$O{=}\overset{\overset{\displaystyle |}{}}{\underset{\underset{\displaystyle Ar^1}{|}}{S}}{=}O \qquad \text{(V)}$$

wherein $Ar^1$ is an aryl group. $Ar^1$ can be chosen from among the aryl groups described in connection with Ar. In a specifically preferred form of the invention $Ar^1$ is a carbocyclic aromatic ring containing from 6 to 10 carbon atoms (e.g., phenyl or naphthyl) which can optionally be substituted. While either electron withdrawing or electron donating substituents can be employed, highly electron donating substituents are not preferred. Substituents other than ballasting groups, discussed below, typically contain up to 8 carbon atoms.

When the arylhydrazide is to be incorporated in a photographic element, it is preferably substituted to reduce its mobility. The aryl groups Ar and $Ar^1$ are convenient sites for introducing substituent moieties for controlling the mobility of the arylhydrazides. Either ballasting moieties or groups for promoting adsorption to silver halide grain surfaces can be employed for this purpose. It is generally most convenient to substitute the Ar group with a mobility controlling group.

Suitable ballasting groups can take conventional forms. For example, the ballasting groups can be similar to those found in common incorporated couplers and other immobile photographic emulsion addenda. The ballast groups typically contain aliphatic and/or aromatic groups that are relatively unreactive, such as alkyl, alkoxy, amido, carbamoyl, oxyamido, carbamoyloxy, carboxy, oxycarbonyl, phenyl, alkylphenyl, phenoxy, alkylphenoxy, and similar groups, with individual ballasts frequently being comprised of combinations of these groups. The ballasting groups generally contain from 8 to about 30 or more carbon atoms. Ballasted arylhydrazides are recognized to be useful in promoting high contrast imaging, which suggests that they retain sufficient mobility to stimulate infectious development.

For applications in which a very close association between the arylhydrazide and the silver halide grain surfaces is desired, such as when the arylhydrazide is employed to increase photographic speed or when nucleation is sought at very low arylhydrazide concentrations, a substituent can be incorporated to promote adsorption to silver halide grain surfaces. Adsorption promoting moieties are preferably linked directly to the aromatic ring of Ar (e.g., the phenyl or naphthyl ring) or can be attached through an intermediate divalent linking group. P-3, P-8 through P-14, RD-1, and RD-2, cited above and here incorporated by reference, disclose useful adsorption promoting moieties as well as intermediate linking groups.

Preferred adsorption promoting moieties are thioamides. Specifically preferred thioamides can be represented by the following formula:

$$R^4-X-\overset{\overset{\displaystyle S}{\|}}{C}-X'- \qquad \text{(VI)}$$

where one of X and X' represents —N($R^5$)— and the other represents —O—, —S—, or —N($R^6$)—, $R^4$ represents hydrogen, an aliphatic residue, an aromatic residue, or together with X or X' completes a 5- or 6-membered heterocyclic ring, $R^5$ or $R^6$ in the X position represents hydrogen, an aliphatic residue, or an aromatic residue, and $R^5$ or $R^6$ in the X' position represents hydrogen or a benzyl substituent when X' is bonded directly to an aromatic ring and can otherwise be chosen from among the same substituents as when in its X position, provided that at least one of $R^4$, $R^5$, and $R^6$ must be hydrogen when each is present.

In one preferred form $R^4$ can be an arylhydrazide. In this instance the resulting compound contains two arylhydrazide moieties and is preferably a bis compound. The nitrogen atom substitution of the arylhydrazide can, for example, satisfy formula I. Alternatively, the arylhydrazide need not be sulfinic acid radical substituted—i.e., both the $\alpha$ and $\beta$ nitrogen atoms can have pendant hydrogen. The arylhydrazide can be linked to the X position directly or through any convenient divalent linking group. When $R^4$ is arylhydrazide $R^5$ or $R^6$ in the X position is preferably hydrogen.

$R^5$ or $R^6$ in the X' position is preferably hydrogen. When $R^5$ or $R^6$ is a benzyl substituent, the ring can be unsubstituted or substituted, such as with alkyl, alkoxy, or halo groups. The alkyl moieties preferably contain from 1 to 8 carbon atoms.

When X and X' are both amino substituents, the entire adsorption promoting moiety is a thiourea group. Preferred thiourea adsorption promoting moieties are those disclosed in P-8, P-9, and P-14, cited above and here incorporated by reference. In addition to the arylhydrazide substituent described above, specifically preferred $R^4$ and $R^5$ or $R^6$ in the X position substituents include alkyl, haloalkyl, alkoxyalkyl, phenylalkyl, phenyl, naphthyl, alkylphenyl, cyanophenyl, halophenyl, or alkoxyphenyl having up to about 18 carbon atoms, with $R^4$ also specifically including hydrogen.

When X is —O— or —S—, any convenient aliphatic or aromatic residue can be linked to the oxygen or sulfur. In general the aliphatic and aromatic residues can be chosen from among groups already described above as Ar substituents. However, when an aromatic ring is directly attached to the oxygen or sulfur, $R^5$ is preferably hydrogen. Oxy substituents are the specific invention of Parton et al U.S. Ser. No. 493,554, filed concurrently herewith and commonly assigned, titled ADSORBABLE ARYLHYDRAZIDES AND APPLICATIONS THEREOF TO SILVER HALIDE PHOTOGRAPHY. Thio substituents are disclosed by P-3, here incorporated by reference.

When X or X' and $R^4$ together form a heterocyclic ring, the ring is preferably a five or six-membered heterocyclic ring. Preferred rings formed by X' and $R^4$ are those found as acidic nuclei in merocyanine dyes. Specific illustrative ring structures are 4-thiazoline-2-thione, thiazolidine-2-thione, 4-oxazoline-2-thione, oxazolidine-2-thione, 2-pyrazoline-5-thione, pyrazolidine-5-thione, indoline-2-thione, 4-imidazoline-2-thione, 2-thiohydantoin, rhodanine, isorhodanine, 2-thio-2,4-oxazolidinedione, and thiobarbituric acid, which can, of course, be further substituted. When X and $R^4$ together form a 5- or 6-membered heterocyclic ring, this ring is preferably a ring of the type formed in cyanine dyes—i.e., an azole or azine ring.

Although adsorption to silver halide grain surfaces is generally weaker, other adsorption promoting moieties can be incorporated into the arylhydrazides, if desired. Heterocyclic rings containing a divalent sulfur atom, such as thiazole (including fused benzo ring variants), promote adsorption. Triazoles (including fused benzo ring variants) promote adsorption. Such heterocyclic rings can be chosen from a variety of such rings known to be useful as cyanine dye forming nuclei.

Sulfinic acid radical substituted arylhydrazides useful in the practice of this invention have been previously synthesized by Hantzsch et al and Borsche et al, cited above. The synthesis of additional specific sulfinic acid radical substituted arylhydrazides is taught in the Examples.

One illustrative method for preparing arylhydrazides which are sulfinic acid radical substituted at the $\alpha$ nitrogen atom is the following:

Anhydrous magnesium sulfate (~0.083 mole) and activated manganese dioxide (0.05 mole) are added to an acetone solution of the appropriate hydrazide (0.02 mole). After stirring at room temperature until the hydrazide is consumed, the reaction mixture is filtered and concentrated to a red oil, which is then dissolved in ethanol. The sulfinic acid (0.02 mole) in ethanol is added to the reaction mixture, followed by distilled water until precipitation takes place. The solid is collected by filtration and recrystallized from ethanol and water mixtures.

An alternative method of achieving $\alpha$ nitrogen atom substitution is the following:

Aqueous solutions of the sulfinic acid salt (1 part) and potassium ferricyanide (2 parts) or cupric chloride (2 parts) are added in rapid succession to an ethanol solution of the appropriate hydrazide (1 part). After three hours, the reaction mixture is diluted with distilled water and filtered to obtain a solid which can be purified by recrystallization from a suitable solvent.

An illustrative method for preparing arylhydrazides which are sulfinic acid radical substituted at the $\beta$ nitrogen atom is as follows:

Aqueous solutions of a sulfinic acid, sodium salt (1 part) and sodium bicarbonate (2 parts) are added to an ethanol solution of hydrazide (1 part). Immediately, an aqueous solution of potassium ferricyanide (2 parts) is added. After 2 hours, the reaction mixture is diluted with water and the product is collected by filtration and purified by recrystallization from a suitable solvent.

The following are illustrative of specific preferred sulfinic acid radical substituted arylhydrazides useful in the practice of this invention:

TABLE I

| | |
|---|---|
| SA-1 | 1-(4-aminophenyl)-2-formyl-2-(4-methylphenylsulfonyl)hydrazine |
| SA-2 | 1-{4-[2-(2,4-bis-t-amylphenoxy)butanamido]phenyl}-2-formyl-2-(4-methylphenylsulfonyl)hydrazine |
| SA-3 | 1-formyl-2-(4-methylphenylsulfonyl)-2-[4-(3-methyl-2-thioureido)phenyl]hydrazine |
| SA-4 | 1-formyl-2-(4-methylphenylsulfonyl)-2-[4-(3-phenylureido)phenyl]hydrazine |
| SA-5 | 1-benzoyl-2-(4-methylphenylsulfonyl)-2-phenylhydrazine |
| SA-6 | 1-benzoyl-1-(4-methylphenylsulfonyl)-2-phenylhydrazine |
| SA-7 | 1-(2,2-dimethylpropanoyl)-1-(4-methylphenylsulfonyl)-2-phenylhydrazine |
| SA-8 | 1-acetyl-1-(4-methylphenylsulfonyl)-2-phenylhydrazine |
| SA-9 | 1-ethoxycarbonyl-1-(4-methylphenylsulfonyl)-2-phenylhydrazine |
| SA-10 | 1-formyl-2-(4-hydroxyphenyl)-2-(4-methylphenylsulfonyl)hydrazine |
| SA-11 | 1-(4-acetoxyphenyl)-2-formyl-1-(4-methylphenylsulfonyl)hydrazine |
| SA-12 | 1-formyl-2-(4-hexanoxyphenyl)-2-(4-methylphenylsulfonyl)hydrazine |
| SA-13 | 1-formyl-2-[4-(tetrahydro-2H—pyran-2-yloxy)phenyl]-2-(4-methylphenylsulfonyl)-hydrazine |

TABLE I-continued

| | |
|---|---|
| SA-14 | 1-formyl-2-[4-(3-hexylureidophenyl)]-2-(4-methylphenylsulfonyl)hydrazine |
| SA-15 | 1-formyl-2-(4-methylphenylsulfonyl)-2-[4-(phenoxythiocarbonylamino)phenyl]hydrazine |
| SA-16 | 1-(4-ethoxythiocarbonylaminophenyl)-2-formyl-1-(4-methylphenylsulfonyl)hydrazine |
| SA-17 | 1-formyl-2-(4-hexanamidophenyl)-2-(4-methylphenylsulfonyl)hydrazine |
| SA-18 | 1-aminocarbonyl-2-phenyl-2-phenylsulfonylhydrazine |
| SA-19 | 1-benzoyl-2-(4-nitrophenylsulfonyl)-2-phenylhydrazine |
| SA-20 | 1-benzoyl-1-(4-methoxyphenylsulfonyl)-2-phenylhydrazine |
| SA-21 | 1-benzoyl-1-(4-methylphenylsulfonyl)-2-(4-hydroxyphenyl)hydrazine |
| SA-22 | 1-benzoyl-2-(4-methoxyphenyl)-1-(4-methylphenylsulfonyl)hydrazine |
| SA-23 | 1-formyl-2-(4-methoxyphenylsulfonyl)-2-(propanoxyphenyl)hydrazine |
| SA-24 | 1-benzoyl-2-(3-methylphenyl)-2-(4-methylphenylsulfonyl)hydrazine |
| SA-25 | 1-benzoyl-2-(4-methylphenyl)-2-(4-methylphenylsulfonyl)hydrazine |
| SA-26 | 1-formyl-2-(4-methylphenylsulfonyl)-2-[4-(3-methyl-3-phenyl-2-thioureido)phenyl]hydrazine |
| SA-27 | 1-{{4-{3-[4-(2,4-bis-t-amylphenoxy)butyl]ureido}phenyl}}-2-formyl-1-(4-methylphenylsulfonyl)hydrazine |

Advantages in photographic performance can be realized by using the sulfinic acid radical substituted arylhydrazides described above so that they are present during development using an aqueous alkaline processing solution in radiation sensitive silver halide emulsions which form latent images either on their surface or internally by the photoelectron reduction of silver ions to silver atoms. Thus, apart from a few specialized silver halide photographic systems, such as photobleach reversal systems and those systems which require dry processing, the sulfinic acid radical substituted arylhydrazides are generally useful with silver halide photographic systems. Such systems and their component features are generally disclosed in *Research Disclosure*, Vol. 176, Dec. 1978, Item 17643, here incorporated by reference.

The arylhydrazide is preferably incorporated directly in the silver halide emulsion layer of a photographic element or can be incorporated in an adjacent hydrophilic colloid layer so that migration to the emulsion layer during processing occurs. While it is preferred to incorporate the sulfinic acid radical substituted arylhydrazides directly in the silver halide emulsions prior to coating to form a photographic element, it is recognized that the hydrazides are effective if incorporated at any time before development of an imagewise exposed photographic element.

The preferred form of the sulfinic acid radical substituted arylhydrazide, its concentration, and its placement are a function of the photographic system employed and the photographic advantage being sought. By way of illustration three differing photographic systems are discussed below.

Direct Positive Imaging

Photographic elements which produce images having an optical density directly related to the radiation received on exposure are said to be negative working. A positive photographic image can be formed by producing a negative photographic image and then forming a second photographic image which is a negative of the first negative, that is, a positive image. A direct positive image is understood in photography to be a positive image that is formed without first forming a negative image. Positive dye images which are not direct positive images are commonly produced in color photography by reversal processing in which a negative silver image is formed and a complementary positive dye image is then formed in the same photographic element. The term "direct reversal" has been applied to direct positive photographic elements and processing which produces a positive dye image without forming a negative silver image. Direct positive photography in general and direct reversal photography in particular are advantageous in providing a more straightforward approach to obtaining positive photographic images.

The sulfinic acid radical substituted arylhydrazides can be employed as nucleating agents with any conventional photographic element capable of forming a direct positive image containing, coated on a photographic support, at least one silver halide emulsion layer containing a vehicle and silver halide grains capable of forming an internal latent image upon exposure to actinic radiation. As employed herein, the terms "internal latent image silver halide grains" and "silver halide grains capable of forming an internal latent image" are employed in the art-recognized sense of designating silver halide grains which produce substantially higher optical densities when coated, imagewise exposed, and developed in an internal developer than when comparably coated, exposed and developed in a surface developer. Preferred internal latent image silver halide grains are those which, when examined according to normal photographic testing techniques, by coating a test portion on a photographic support (e.g., at a coverage of from 3 to 4 grams per square meter), exposing to a light intensity scale (e.g., with a 500-watt tungsten lamp at a distance of 61 cm) for a fixed time (e.g., between $1\times10^{-2}$ and 1 second) and developing for 5 minutes at 25° C. in Kodak Developer DK-50 (a surface developer), provide a density of at least 0.5 less than when this testing procedure is repeated, substituting for the surface developer Kodak Developer DK-50 containing 0.5 gram per liter of potassium iodide (an internal developer). The internal latent image silver halide grains most preferred for use in the practice of this invention are those which, when tested using an internal developer and a surface developer as indicated above, produce an optical density with the internal developer at least 5 times that produced by the surface developer. It is additionally preferred that the internal latent image silver halide grains produce an optical density of less than 0.4 and, most preferably, less than 0.25 when coated, exposed and developed in surface developer as indicated above, that is, the silver halide grains are preferably initially substantially unfogged and free of latent image on their surface.

The surface developer referred to herein as Kodak Developer DK-50 is described in the *Handbook of Chemistry and Physics*, 30th edition, 1947, Chemical Rubber Publishing Company, Cleveland, Ohio, page 2558, and has the following composition:

| | |
|---|---|
| Water, about 125° F. (52° C.) | 500.0 cc |
| N—methyl-p-aminophenol hemisulfate | 2.5 g |
| Sodium sulfite, desiccated | 30.0 g |
| Hydroquinone | 2.5 g |
| Sodium metaborate | 10.0 g |
| Potassium bromide | 0.5 g |

-continued

| | |
|---|---|
| Water to make | 1.0 liter. |

Internal latent image silver halide grains which can be employed in the practice of this invention are well known in the art. Patents teaching the use of internal latent image silver halide grains in photographic emulsions and elements include Davey et al U.S. Pat. No. 2,592,250, Porter et al U.S. Pat. No. 3,206,313, Milton U.S. Pat. No. 3,761,266, Ridgway U.S. Pat. No. 3,586,505, Gilman et al U.S. Pat. No. 3,772,030, Gilman et al U.S. Pat. No. 3,761,267, and Evans U.S. Pat. No. 3,761,276, the disclosures of which are hereby incorporated by reference.

It is specifically preferred to employ high aspect ratio tabular grain internal latent image forming emulsions. Such emulsions are the specific subject matter of Evans et al U.S. Ser. No. 431,912, filed Sept. 30, 1982, commonly assigned, titled DIRECT REVERSAL EMULSIONS AND PHOTOGRAPHIC ELEMENTS USEFUL IN IMAGE TRANSFER FILM UNITS, now abandoned in favor of U.S. Ser. No. 564,976, filed Nov. 12, 1982. These emulsions are also disclosed in *Research Disclosure,* Vol. 225, Jan. 1983, Item 22534.

The internal latent image silver halide grains preferably contain bromide as the predominant halide. The silver bromide grains can consist essentially of silver bromide or can contain silver bromoiodide, silver chlorobromide, silver chlorobromoiodide crystals and mixtures thereof. Internal latent image forming sites can be incorporated into the grains by either physical or chemical internal sensitization. Davey et al, cited above, for example, teaches the physical formation of internal latent image forming sites by the halide conversion technique. Chemical formation of internal latent image forming sites can be produced through the use of sulfur, gold, selenium, tellurium and/or reduction sensitizers of the type described, for example, in Sheppard et al U.S. Pat. No. 1,623,499, Waller et al U.S. Pat. No. 2,399,083, McVeigh U.S. Pat. No. 3,297,447, and Dunn U.S. Pat. No. 3,297,446, as taught in the patents cited in the preceding paragraph. Internal latent image sites can also be formed through the incorporation of metal dopants, particularly Group VIII noble metals, such as, ruthenium, rhodium, palladium, iridium, osmium and platinum, as taught by Berriman U.S. Pat. No. 3,367,778. The preferred foreign metal ions are polyvalent metal ions which include the above noted Group VIII dopants, as well as polyvalent metal ions such as lead, antimony, bismuth, and arsenic. In a preferred approach, the internal latent image sites can be formed within the silver halide grains during precipitation of silver halide. In an alternate approach, a core grain can be formed which is treated to form the internal image sites and then a shell deposited over the core grains, as taught by Porter et al, cited above.

The silver halide grains employed in the practice of this invention are preferably monodispersed and in some embodiments are preferably large grain emulsions made according to Wilgus German OLS No. 2,107,118, which is incorporated herein by reference. The monodispersed emulsions are those which comprise silver halide grains having a substantially uniform diameter. Generally, in such emulsions, no more than about 5 percent by number of the silver halide grains smaller than the mean grain size and/or no more than about 5 percent by number of the silver halide grains larger than the mean grain size vary in diameter from the mean grain diameter by more than about 40 percent. Preferred photographic emulsions of this invention comprise silver halide grains, at least 95 percent by weight of said grains having a diameter which is within 40 percent and preferably within about 30 percent of the mean grain diameter. Mean grain diameter, i.e., average grain size, can be determined using conventional methods, e.g., such as projective area, as shown in an article by Trivelli and Smith entitled "Empirical Relations Between Sensitometric and Size-Frequency Characteristics in Photographic Emulsion Series" in *The Photographic Journal,* Volume LXXIX, 1939, pages 330 through 338. The aforementioned uniform size distribution of silver halide grains is a characteristic of the grains in monodispersed photographic silver halide emulsions. Silver halide grains having a narrow size distribution can be obtained by controlling the conditions at which the silver halide grains are prepared using a double run procedure. In such a procedure, the silver halide grains are prepared by simultaneously running an aqueous solution of a silver salt, such as silver nitrate, and an aqueous solution of a water soluble halide, for example, an alkali metal halide such as potassium bromide, into a rapidly agitated aqueous solution of a silver halide peptizer, preferably gelatin, a gelatin derivative or some other protein peptizer. Suitable methods for preparing photographic silver halide emulsions having the required uniform particle size are disclosed in an article entitled "Ia: Properties of Photographic Emulsion Grains", by Klein and Moisar, *The Journal of Photographic Science,* Volume 12, 1964, pages 242 through 251; an article entitled "The Spectral Sensitization of Silver Bromide Emulsions on Different Crystallographic Faces", by Markocki, *The Journal of Photographic Science,* Volume 13, 1965, pages 85 through 89; an article entitled "Studies on Silver Bromide Sols, Part I. The Formation and Aging of Monodispersed Silver Bromide Sols", by Ottewill and Woodbridge, *The Journal of Photographic Science,* Volume 13, 1965, pages 98 through 103; and an article entitled "Studies on Silver Bromide Sols, Part II. The Effect of Additives on the Sol Particles", by Ottewill and Woodbridge, *The Journal of Photographic Science,* Volume 13, 1965, pages 104 through 107.

Where internal latent image sites have been formed through internal chemical sensitization or the use of metal dopants, the surface of the silver halide grains can be sensitized to a level below that which will produce substantial density in a surface developer, that is, less than 0.4 (preferably less than 0.25) when coated, exposed and surface developed as described above. The silver halide grains are preferably predominantly silver bromide grains chemically surface sensitized to a level which would provide a maximum density of at least 0.5 using undoped silver halide grains of the same size and halide composition when coated, exposed and developed as described above.

Surface chemical sensitization can be undertaken using techniques such as those disclosed by Sheppard, Waller et al, McVeigh or Dunn, cited above. The silver halide grains can also be surface sensitized with salts of the noble metals, such as, ruthenium, palladium and platinum. Representative compounds are ammonium chloropalladate, potassium chloroplatinate and sodium chloropalladite, which are used for sensitizing in amounts below that which produces any substantial fog inhibition, as described in Smith et al U.S. Pat. No.

2,448,060, and as antifoggants in higher amounts, as described in Trivelli et al U.S. Pat. Nos. 2,566,245 and 2,566,263. The silver halide grains can also be chemically sensitized with reducing agents, such as stannous salts (Carroll U.S. Pat. No. 2,487,850, polyamines, such as diethylene triamine (Lowe et al U.S. Pat. No. 2,518,698), polyamines, such as spermine (Lowe et al U.S. Pat. No. 2,521,925), or bis-(β-aminoethyl)sulfide and its water soluble salts (Lowe et al U.S. Pat. No. 2,521,926).

Photographic emulsion layers, and other layers of photographic elements, such as, overcoat layers, interlayers, and subbing layers, as well as receiving layers in image transfer elements, can also contain as vehicles water permeable hydrophilic colloids as vehicles alone or in combination with vehicle extenders (e.g., in the form of latices), such as synthetic polymeric peptizers, carriers and/or binders. Such materials are more specifically described in *Research Disclosure,* Item 17643, cited above, Section IX. Vehicles are commonly employed with one or more hardeners, such as those described in Section X.

The layers of the photographic elements can be coated on any conventional photographic support. Typical useful photographic supports are disclosed in *Research Disclosure,* Item 17643, cited above, Section XVII.

A simple exposure and development process can be used to form a direct positive image. In one embodiment, a photographic element comprising at least one layer of a silver halide emulsion as described above can be imagewise exposed to light and then developed in a silver halide surface developer.

It is understood that the term "surface developer" encompasses those developers which will reveal the surface latent image on a silver halide grain, but will not reveal substantial internal latent image in an internal image forming emulsion, and under the conditions generally used develop a surface sensitive silver halide emulsion. The surface developers can generally utilize any of the silver halide developing agents or reducing agents, but the developing bath or composition is generally substantially free of a silver halide solvent (such as water soluble thiocyanates, water soluble thioethers, thiosulfates, and ammonia) which will disrupt or dissolve the grain to reveal substantial internal image. Low amounts of excess halide are sometimes desirable in the developer or incorporated in the emulsion as halide releasing compounds, but high amounts of iodide or iodide releasing compounds are generally avoided to prevent substantial disruption of the grain. Typical silver halide developing agents which can be used in the developing compositions employed in the use of this invention include hydroquinones, catechols, aminophenols, 3-pyrazolidones, ascorbic acid and its derivatives, reductones and color developing agents, that is, primary aromatic amine developing agents, such as, aminophenols and paraphenylenediamines. The color developing agents are preferably employed in combination with black-and-white developing agents capable of acting as electron transfer agents. Illustrative of useful surface developers are those disclosed in Ives U.S. Pat. No. 2,563,785, Evans U.S. Pat. No. 3,761,276, Knott et al U.S. Pat. No. 2,456,953, and Juoy U.S. Pat. No. 3,511,662.

Where the developing agents are initially entirely incorporated in the photographic elements, the remaining components (e.g., water, activators to adjust pH, preservatives, etc.) normally present in surface developers constitute what is commonly referred to as an activator solution. Except for the omission of the developing agent, activator solutions are identical to developer solutions in composition and are employed identically with incorporated developing agent photographic elements. Subsequent references to developing compositions are inclusive of both developer and activator solutions.

The surface developers are alkaline. Conventional activators, preferably in combination with buffers, such as, sodium hydroxide, potassium hydroxide, sodium carbonate, potassium carbonate, trisodium phosphate or sodium metaphosphate, can be employed to adjust pH to a desired alkaline level. The amounts of these materials present are selected so as to adjust the developer to a pH in the range of from 10 to 13, preferably from about 10.5 to 12.5.

The developing compositions can contain certain antifoggants and development restrainers, or, optionally, they can be incorporated in layers of the photographic element. For example, in some applications, improved results can be obtained when the direct positive emulsions are processed in the presence of certain antifoggants, as disclosed in Stauffer U.S. Pat. No. 2,497,917, Land U.S. Pat. No. 2,704,721, Rogers et al U.S. Pat. No. 3,265,498, and Baldassari et al U.S. Pat. No. 3,925,086, which are incorporated herein by reference.

Preferred antifoggants are benzotriazoles, such as, benzotriazole (that is, the unsubstituted benzotriazole compound), halo-substituted benzotriazoles (e.g., 5-chlorobenzotriazole, 4-bromobenzotriazole, and 4-chlorobenzotriazole), and alkyl-substituted benzotriazoles wherein the alkyl moiety contains from about 1 to 12 carbon atoms (e.g., 5-methylbenzotriazole). Other known useful antifoggants include benzimidazoles, such as, 5-nitrobenzimidazole, benzothiazoles, such as, 5-nitrobenzothiazole and 5-methylbenzothiazole, heterocyclic thiones, such as, 1-methyl-2-tetrazoline-5-thione, triazines, such as, 2,4-dimethylamino-6-chloro-5-triazine, benzoxazoles, such as, ethylbenzoxazole, and pyrroles, such as, 2,5-dimethylpyrrole and the like.

Improved results are obtained when the element is processed in the presence of the antifoggants mentioned above. The antifoggants can be present in the processing solution during development or incorporated in the photographic element. It is preferred to incorporate the antifoggant in the processing solution. Concentrations of from about 1 mg to 5 grams per liter are contemplated, with concentrations of from about 5 to 500 mg per liter being preferred. Optimum antifoggant concentrations are a function of the specific antifoggant, element, and processing solution employed.

It is specifically contemplated that the sulfinic acid radical substituted arylhydrazide nucleating agents of the present invention can be employed alone or in combination with conventional nucleating agents, such as those of the quaternary ammonium salt, hydrazine, hydrazide, and hydrazone type. In addition to the patents cited above to illustrate known nucleating agents, such conventional nucleating agents are also illustrated by Adachi et al U.S. Pat. No. 4,115,122, Kurtz et al U.S. Pat. Nos. 3,719,494 and 3,734,738, and Baralle et al U.S. Pat. Nos. 4,306,016, 4,306,017, and 4,315,986. The sulfinic acid radical substituted arylhydrazide nucleating agents can be employed in any desired concentration that will permit a degree of selectivity in developing imagewise silver halide grains capable of forming an internal latent image, which grains have not been imagewise exposed, as compared to silver halide grains containing an internal latent image formed by imagewise exposure. The nucleating agents can be incorporated in the photographic element in previously taught concentrations, typically up to $10^{-2}$ mole per mole of silver. The nucleating agents can be incorporated by procedures similar to those employed for introducing other photographic addenda, such as illustrated by *Research Disclosure,* Item 17643, cited above, Section XIV, here incorporated by reference.

It is preferred to incorporate the sulfinic acid radical substituted arylhydrazide nucleating agents into the silver halide emulsions in concentrations of from $10^{-5}$ to about $10^{-2}$ mole per mole of silver halide. Where an efficient adsorption promoting moiety is incorporated in the sulfinic acid radical substituted arylhydrazide nucleating agent, such as indicated by formula VI, it is generally unnecessary to provide nucleating concentrations in excess of about $10^{-2}$ mole per mole of silver halide. Where the nucleating agent is to be adsorbed to the surface of the silver halide grains, it can be adsorbed using the procedures well known to those skilled in the art for adsorbing sensitizing dyes, such as, cyanine and merocyanine dyes, to the surface of silver halide grains.

The essential features of the sulfinic acid radical substituted arylhydrazide nucleating agents and the direct positive silver halide emulsions and photographic elements in which they are incorporated, as well as procedures for their use and processing, are described above. It is appreciated that, in preferred photographic applications, the emulsions and elements can contain additional features which are in themselves well known to those familiar with the photographic arts, such as those disclosed in *Research Disclosure,* Item 17643, cited above and here incorporated by reference. Certain specifically preferred features are described below.

The silver halide emulsions can be spectrally sensitized with cyanine, merocyanine, and other polymethine dyes and supersensitizing combinations thereof well known in the art. Spectral sensitizers in conventional surface sensitive emulsions are comparably effective in the emulsions of this invention. In general, they enhance nucleation. Nonionic, zwitterionic and anionic spectral sensitizers are preferred. Particularly effective are carboxy substituted merocyanine dyes of the thiohydantoin type described by Stauffer et al U.S. Pat. No. 2,490,758.

Effective red sensitizers are the carbocyanines of formula (VII)

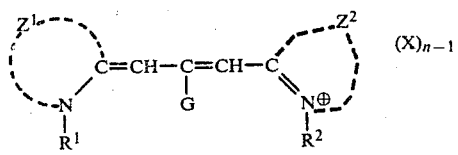

(VII)

wherein each of $Z^1$ and $Z^2$ represents the atoms necessary to form a benzothiazole, benzoselenazole, naphthothiazole, or naphthoselenazole, the benzothiazole and benzoselenazole being preferably 5- and/or 6-substituted with groups such as lower alkyl, lower alkoxy, chloro, bromo, fluoro, hydroxy, acylamino, cyano, and trifluoromethyl, G represents hydrogen and lower alkyl, preferably ethyl or methyl, each of $R^1$ and $R^2$ represents lower alkyl or hydroxy(lower)alkyl, at least one of $R^1$ and $R^2$ being preferably acid substituted(lower)alkyl, such as, carboxyethyl, sulfopropyl, and sulfatoethyl, X represents or charge balancing counter ion, and n is 1 or 2.

Particularly effective are certain supersensitizing combinations of the above dyes with each other and with dyes or other adsorbed organic compounds having polarographic oxidation potentials ($E_{ox}$) of about 0.3 to 0.9 volt. Many such combinations are described in Mees U.S. Pat. No. 2,075,048, Carroll et al U.S. Pat. Nos. 2,313,922, 2,533,426, 2,688,545, and 2,704,714, Jones U.S. Pat. No. 2,704,717, and Schwan U.S. Pat. No. 3,672,898, and include, as well, the acid substituted analogues thereof well known in the art.

Effective green sensitizers are carbocyanines and cyanines of formulas (VIII) and (IX)

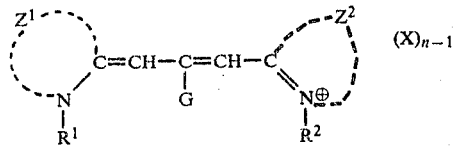

(VIII)

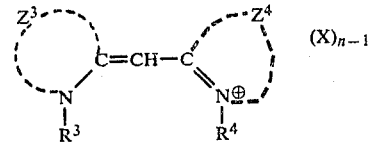

(IX)

wherein each of $Z^1$ and $Z^2$ represents the atoms necessary to form benzoxazole and benzimidazole nuclei, benzimidazole being substituted in the 3-position by lower alkyl or aryl, and preferably in the 5- and/or 6-positions with groups selected from fluoro, chloro, bromo, lower alkyl, cyano, acylamino and trifluoromethyl, and the benzoxazole ring preferably substituted in the 5- or 6-positions with lower alkyl, lower alkoxy, phenyl, fluoro, chloro, and bromo, $Z^3$ represents the atoms necessary to form benzothiazole, benzoselenazole, naphthothiazole, naphthoselenazole, or 2-quinoline, $Z^4$ represents the atoms necessary to form 2-quinoline, G represents lower alkyl and, if at least one of $Z^1$ and $Z^2$ forms benzimidazole, hydrogen, each of $R^1$, $R^2$, $R^3$ and $R^4$ represents lower alkyl or hydroxy(lower)alkyl, at least one of $R^1$ and $R^2$ and of $R^3$ and $R^4$ being preferably acid substituted (lower) alkyl such as carboxyethyl, sulfopropyl, and sulfatoethyl, X represents a charge balancing counter ion, and n is 1 or 2.

Particularly effective are certain supersensitizing combinations of the above dyes, such as those described in Carroll et al U.S. Pat. Nos. 2,688,545 and 2,701,198, Nys et al U.S. Pat. No. 2,973,264, and Schwan et al U.S. Pat. No. 3,397,069 and their acid substituted analogues well known in the art.

Effective blue sensitizers are simple cyanines and merocyanines of formulas (X) and (XII)

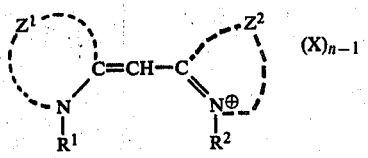

(X)

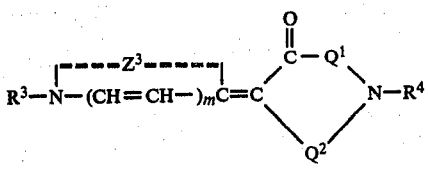

(XI)

wherein each of $Z^1$ and $Z^2$ represents the atoms necessary to form benzothiazole, benzoselenazole, naphthothiazole and naphthoselenazole nuclei which may be substituted with groups such as chloro, methyl or methoxy, chloro, bromo, lower alkyl, or lower alkoxy, $Z^3$ represents benzothiazole, benzoselenazole which may be substituted as in $Z^1$ and $Z^2$, and a pyridine nucleus, $Q^1$ and $Q^2$ together represent the atoms necessary to complete a rhodanine, 2-thio-2,4-oxazolidinedione or 2-thiohydantoin ring, the latter having a second nitrogen atom with a substituent $R^5$, m represents 0 or 1, each of $R^1$, $R^2$ and $R^3$ represents lower alkyl or hydroxy(lower)alkyl, at least one of $R^1$ and $R^2$ being preferably acid substituted(lower)alkyl such as carboxyethyl, sulfopropyl, and sulfatoethyl, $R^4$ and $R^5$ represent lower alkyl and hydroxy (lower-)alkyl, and $R^4$ additionally can represent carboxyalkyl and sulfoalkyl, X is a charge balancing counter ion, and n is 1 or 2.

(Lower alkyl in each occurrence of Formulas VII to XI includes from 1 to 5 carbon atoms.)

In one preferred form the photographic elements can produce silver images. Specifically preferred photographic elements for producing silver images are those disclosed in Hoyen and Silverman U.S. Pat. Nos. 4,444,865 and 4,444,874, commonly assigned, and here incorporated by reference. In another preferred form the photographic elements can be color photographic elements which form dye images through the selective destruction, formation or physical removal of dyes.

The photographic elements can produce dye images through the selective destruction of dyes or dye precursors, such as silver-dye-bleach processes, as illustrated by A. Meyer, *The Journal of Photographic Science,* Volume 13, 1965, pages 90 through 97. Bleachable azo, azoxy, xanthene, azine, phenylmethane, nitroso complex, indigo, quinone, nitro substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291, and Anderau et al U.S. Pat. Nos. 3,178,285 and 3,178,290 as well as their hydrazo, diazonium, and tetrazolium precursors and leuco and shifted derivatives, as illustrated by U.K. Pat. Nos. 923,265, 999,996, and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372, and Puschel et al U.S. Pat. No. 3,561,970 can be employed.

The photographic elements can produce dye images through the selective formation of dyes, such as by reacting (coupling) a color developing agent (e.g., a primary aromatic amine) in its oxidized form with a dye forming coupler. The dye forming couplers can be incorporated in the photographic elements, as illustrated by Schneider et al, *Die Chemie,* Volume 57, 1944, page 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435, and Chen *Research Disclosure,* Volume 159, July 1977, Item 15930.

In one form, the dye forming couplers are chosen to form subtractive primary (i.e., yellow, magenta, and cyan) image dyes and are nondiffusible, colorless couplers, such as, two- and four-equivalent couplers of the open chain ketomethylene, pyrazolone, pyrazolotriazole, pyrazolobenzimidazole, phenol, and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316, and 2,367,531, Loria et al U.S. Pat. Nos. 2,772,161, 2,600,788, 3,006,759, 3,214,437, and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506, and 3,384,657, Porter et al U.S. Pat. No. 2,343,703, Greenhalgh et al U.S. Pat. No. 3,127,269, Feniak et al U.S. Pat. Nos. 2,865,748, 2,933,391, and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, and 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924, and Whitmore et al U.S. Pat. No. 3,227,550.

The photographic elements can incorporate alkali soluble ballasted couplers, as illustrated by Froelich et al and Tong, cited above. The photographic elements can be adapted to form nondiffusible image dyes using dye forming couplers in developers, as illustrated by U.K. Pat. No. 478,984, Yager et al U.S. Pat. No. 3,113,864, Vittum et al U.S. Pat. Nos. 3,002,836, 2,271,238, and 2,362,598, Schwan et al U.S. Pat. No. 2,950,970, Carroll et al U.S. Pat. No. 2,592,243, Porter et al U.S. Pat. Nos. 2,343,703, 2,376,380, and 2,369,489, Spath U.K. Pat. No. 886,723 and U.S. Pat. No. 2,899,306, Tuite U.S. Pat. No. 3,152,896, and Mannes et al U.S. Pat. Nos. 2,115,394, 2,252,718, and 2,108,602.

The dye forming couplers upon coupling can release photographically useful fragments, such as, development inhibitors or accelerators, bleach accelerators, developing agents, silver halide solvents, toners, hardeners, fogging agents, antifoggants, competing couplers, chemical or spectral sensitizers, and desensitizers. Development inhibitor releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwara et al U.S. Pat. No. 3,770,436, and Matsuo et al U.S. Pat. No. 3,808,945. DIR compounds which do not form dye upon reaction with oxidized color developing agents can be employed, as illustrated by Fujiwhara et al German OLS No. 2,529,350 and U.S. Pat. Nos. 3,928,041, 3,958,993, and 3,961,959, Odenwalder et al German OLS No. 2,448,063, Tanaka et al German OLS No. 2,610,546, Kikuchi et al U.S. Pat. No. 4,049,455, and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445, and Rees et al U.S. Pat. No. 3,287,129.

The photographic elements can incorporate colored dye forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432, and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832, and Weller et al U.S. Pat. No. 2,689,793.

The photographic elements can produce dye images through the selective removal of dyes. Negative or positive dye images can be produced by the immobilization of incorporated color providing substances as a function of exposure and development, as illustrated by U.K. Pat. Nos. 1,456,413, 1,479,739, 1,475,265, and 1,471,752, Friedman U.S. Pat. No. 2,543,691, Whitmore U.S. Pat. No. 3,227,552, Bloom et al U.S. Pat. No. 3,443,940, Morse U.S. Pat. No. 3,549,364, Cook U.S. Pat. No. 3,620,730, Danhauser U.S. Pat. No. 3,730,718, Staples U.S. Pat. No. 3,923,510, Oishi et al U.S. Pat. No. 4,052,214, and Fleckenstein et al U.S. Pat. No. 4,076,529.

The photographic elements can contain antistain agents (i.e., oxidized developing agent scavengers) to prevent developing agents oxidized in one dye image layer unit from migrating to an adjacent dye image layer unit. Such antistain agents include ballasted or otherwise non-diffusing antioxidants, as illustrated by Weissberger et al U.S. Pat. No. 2,336,327, Loria et al U.S. Pat. No. 2,728,659, Vittum et al U.S. Pat. No. 2,360,290, Jelley et al U.S. Pat. No. 2,403,721, and Thirtle et al U.S. Pat. No. 2,701,197. To avoid autooxidation the antistain agents can be employed in combination with other antioxidants, as illustrated by Knechel et al U.S. Pat. No. 3,700,453.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337, and smith et al U.S. Pat. No. 4,042,394.

This invention is particularly useful with photographic elements used in image transfer processes or in image transfer film units.

Image transfer systems include colloid transfer systems, as illustrated by Yutzy et al U.S. Pat. Nos. 2,596,756 and 2,716,059, silver salt diffusion transfer systems, as illustrated by Rott U.S. Pat. No. 2,352,014, Land U.S. Pat. No. 2,543,181, Yackel et al U.S. Pat. No. 3,020,155, and Land U.S. Pat. No. 2,861,885, imbibition transfer systems, as illustrated by Minsk U.S. Pat. No. 2,882,156, and color image transfer systems, as illustrated by *Research Disclosure,* Volume 151, Nov. 1976, Item 15162, and Volume 123, July 1974, Item 12331.

Color image transfer systems (including emulsion layers, receiving layers, timing layers, acid layers, processing compositions, supports, and cover sheets) and the images they produce can be varied by choosing among a variety of features, combinations of which can be used together as desired.

Film units can be chosen which are either integrally laminated or separated during exposure, processing and/or viewing, as illustrated by Rogers U.S. Pat. No. 2,983,606, Beavers et al U.S. Pat. No. 3,445,228, Whitmore, Canadian Pat. No. 674,082, Friedman et al U.S. Pat. No. 3,309,201, Land U.S. Pat. Nos. 2,543,181, 3,053,659, 3,415,644, 3,415,645, and 3,415,646, and Barr et al U.K. Pat. No. 1,330,524.

A variety of approaches are known in the art for obtaining transferred dye images. The approaches can be generally categorized in terms of the initial mobility of dye or dye precursor. (Initial mobility refers to the mobility of the dye or dye precursor when it is contacted by the processing solution. Initially mobile dyes and dye precursors as coated do not migrate prior to contact with processing solution.)

Dye image providing compounds are classified as either positive working or negative working. Positive working dye image providing compounds are those which produce a positive transferred dye image when employed in combination with a conventional, negative working silver halide emulsion. Negative working dye image providing compounds are those which produce a negative transferred dye image when employed in combination with conventional, negative working silver halide emulsions. When, as in the present invention, the silver halide emulsions are direct positive emulsions, positive working dye image providing compounds produce negative transferred dye images and negative working dye image providing compounds produce positive transferred dye images.

Image transfer systems, which include both the dye image providing compounds and the silver halide emulsions, are positive working when the transferred dye image is positive and negative working when the transferred dye image is negative. When a retained dye image is formed, it is opposite in sense to the transferred dye image.

A variety of dye image transfer systems have been developed and can be employed in the practice of this invention. One approach is to employ ballasted dye forming (chromogenic) or nondye forming (nonchromogenic) couplers having a mobile dye attached at a coupling-off site. Upon coupling with an oxidized color developing agent, such as a para-phenylenediamine, the mobile dye is displaced so that it can transfer to a receiver. This negative working image transfer approach is illustrated by Whitmore et al U.S. Pat. No. 3,227,550, Whitmore U.S. Pat. No. 3,227,552, and Fujihara et al U.K. Pat. No. 1,445,797, the disclosures of which are here incorporated by reference.

In a preferred image transfer system according to this invention employing negative working dye image providing compounds, a cross oxidizing developing agent (electron transfer agent) develops silver halide and then cross oxidizes with a compound containing a dye linked through an oxidizable sulfonamido group, such as a sulfonamidophenol, sulfonamidoaniline, sulfonamidoanilide, sulfonamidopyrazolobenzimidazole, sulfonamidoindole or sulfonamidopyrazole. Following cross oxidation, hydrolytic deamidation cleaves the mobile dye with the sulfonamido group attached. Such systems are illustrated by Fleckenstein U.S. Pat. Nos. 3,928,312 and 4,053,312, Fleckenstein et al U.S. Pat. No. 4,076,529, Melzer et al U.K. Pat. No. 1,489,694, Deguchi, German OLS No. 2,729,820, Koyama et al, German OLS No. 2,613,005, Vetter et al German OLS No. 2,505,248, and Kestner et al *Research Disclosure,* Volume 151, Nov. 1976, Item 15157. Also specifically contemplated are otherwise similar systems which employ an immobile, dye releasing (a) hydroquinone, as illustrated by Gompf et al U.S. Pat. No. 3,698,897 and Anderson et al U.S. Pat. No. 3,725,062, (b) para-phenylenediamine, as illustrated by Whitmore et al Canadian Pat. No. 602,607, or (c) quaternary ammonium compound, as illustrated by Becker et al U.S. Pat. No. 3,728,113.

Another specifically contemplated dye image transfer system which is negative working reacts an oxidized electron transfer agent or, specifically, in certain forms, an oxidized para-phenylenediamine with a ballasted phenolic coupler having a dye attached through a sulfonamido linkage. Ring closure to form a phenazine releases mobile dye. Such an imaging approach is illustrated by Bloom et al U.S. Pat. Nos. 3,443,939 and 3,443,940.

In still another negative working system, ballasted sulfonylamidrazones, sulfonylhydrazones or sulfonylcarbonylhydrazides can be reacted with oxidized para-phenylenediamine to release a mobile dye to be transferred, as illustrated by Puschel et al U.S. Pat. Nos. 3,628,952 and 3,844,785. In an additional negative working system, a hydrazide can be reacted with silver halide having a developable latent image site and thereafter decompose to release a mobile, transferable dye, as illustrated by Rogers U.S. Pat. No. 3,245,789, Kohara et al, *Bulletin Chemical Society of Japan,* Volume 43, pages 2433 through 2437, and Lestina et al *Research Disclosure,* Volume 28, Dec. 1974, Item 12832.

Image transfer systems employing negative working image dye providing compounds are also known in which dyes are not initially present, but are formed by reactions occurring in the photographic element or receiver following exposure. For example, a ballasted coupler can react with color developing agent to form a mobile dye, as illustrated by Whitmore et al U.S. Pat. No. 3,227,550, Whitmore U.S. Pat. No. 3,227,552, Bush et al U.S. Pat. No. 3,791,827, and Viro et al U.S. Pat. No. 4,036,643. An immobile compound containing a coupler can react with oxidized para-phenylenediamine to release a mobile coupler which can react with additional oxidized para-phenylenediamine before, during or after release to form a mobile dye, as illustrated by Figueras et al U.S. Pat. No. 3,734,726 and Janssens et al German OLS No. 2,317,134. In another form, a ballasted amidrazone reacts with an electron transfer agent as a function of silver halide development to release a mobile amidrazone which reacts with a coupler to form a dye at the receiver, as illustrated by Ohyama et al U.S. Pat. No. 3,933,493.

An image to be viewed can be transferred from the image forming layers. A retained image can be formed for viewing as a concurrently formed complement of the transferred image. Positive transferred images and useful negative retained images can be formed with the direct positive silver halide emulsions of this invention when imaging chemistry is negative working. Images retained in and transferred from the image forming layers are illustrated by U.K. Pat. No. 1,456,413, Friedman U.S. Pat. No. 2,543,691, Bloom et al U.S. Pat. No. 3,443,940, Staples U.S. Pat. No. 3,923,510, and Fleckenstein et al U.S. Pat. No. 4,076,529.

Where mobile dyes are transferred to the receiver a mordant is commonly present in a image dye providing layer. Mordants and mordant containing layers are described in the following references which are incorporated by reference: Sprague et al U.S. Pat. No. 2,548,564, Weyerts U.S. Pat. No. 2,548,575, Carroll et al U.S. Pat. No. 2,675,316, Yutzy et al U.S. Pat. No. 2,713,305, Saunders et al U.S. Pat. No. 2,756,149, Reynolds et al U.S. Pat. No. 2,768,078, Gray et al U.S. Pat. No. 2,839,401, Minsk U.S. Pat. Nos. 2,882,156 and 2,945,006, Whitmore et al U.S. Pat. No. 2,940,849, Condax U.S. Pat. No. 2,952,566, Mader et al U.S. Pat. No. 3,016,306, Minsk et al U.S. Pat. Nos. 3,048,487 and 3,184,309, Bush U.S. Pat. No. 3,271,147, Whitmore U.S. Pat. No. 3,271,148, Jones et al U.S. Pat. No. 3,282,699, Wolf et al U.S. Pat. No. 3,408,193, Cohen et al U.S. Pat. Nos. 3,488,706, 3,557,066, 3,625,694, 3,709,690, 3,758,445, 3,788,855, 3,898,088, and 3,944,424, Cohen U.S. Pat. No. 3,639,357, Taylor U.S. Pat. No. 3,770,439, Campbell et al U.S. Pat. Nos. 3,958,995 and 4,193,795; and Ponticello et al *Research Disclosure,* Vol. 120, April 1974, Item 12045.

One-step processing can be employed, as illustrated by U.K. Pat. No. 1,471,752, Land U.S. Pat. No. 2,543,181, Rogers U.S. Pat. No. 2,983,606 (pod processing), Land U.S. Pat. No. 3,485,628 (soak image former and laminate to receiver) and Land U.S. Pat. No. 3,907,563 (soak receiver and laminate to image forming element) or multi-step processing can be employed, as illustrated by Yutzy U.S. Pat. No. 2,756,142, Whitmore et al U.S. Pat. No. 3,227,550, and Faul et al U.S. Pat. No. 3,998,637.

Preformed reflective layers can be employed, as illustrated by Whitmore Canadian Pat. No. 674,082, Beavers U.S. Pat. No. 3,445,228, Land U.S. Pat. Nos. 2,543,181, 3,415,644, '645 and '646, and Barr et al U.K. Pat. No. 1,330,524 or processing formed reflective layers can be employed, as illustrated by Land U.S. Pat. Nos. 2,607,685 and 3,647,437, Rogers U.S. Pat. No. 2,983,606, and Buckler U.S. Pat. No. 3,661,585.

Generally, the image transfer film units in accordance with this invention comprise:

(1) a photographic element comprising a support having thereon at least one silver halide emulsion layer containing radiation sensitive internal latent image silver halide grains and a nucleating agent, the emulsion layer preferably having in contact therewith an image dye providing material, (2) an image receiving layer, which can be located on a separate support and superposed or adapted to be superposed on the photographic element or, preferably, can be coated as a layer in the photographic element, (3) an alkaline processing composition, (4) means containing and adapted to release the alkaline processing composition into contact with the emulsion layer, and (5) a silver halide developing agent located in at least one of the photographic element and alkaline processing composition so that the processing composition and developing agent, when brought together, form a silver halide surface developer.

In highly preferred embodiments, the film units of this invention contain a support having thereon a layer containing a blue sensitive emulsion and in contact therewith a yellow image dye providing material, a red sensitive silver halide emulsion and in contact therewith a cyan image dye providing material, and a green sensitive emulsion and in contact therewith a magenta image dye providing material, and preferably all of said image dye providing materials are initially immobile image dye providing materials.

The terms "diffusible" (or "mobile") and "immobile" (or "nondiffusible"), as used herein, refer to compounds which are incorporated in the photographic element and, upon contact with an alkaline processing solution, are substantially diffusible or substantially immobile, respectively, in the hydrophilic colloid layers of a photographic element.

The term "image dye providing material", as used herein, is understood to refer to those compounds which are employed to form dye images in photographic elements. These compounds include dye developers, shifted dyes, color couplers, oxichromic compounds, dye redox releasers, etc, as described above in connection with positive working and negative working image transfer systems.

In one preferred embodiment, the receiver layer is coated on the same support with the photosensitive silver halide emulsion layers, the support is preferably a transparent support, an opaque layer is preferably positioned between the image receiving layer and the photosensitive silver halide layer, and the alkaline processing composition preferably contains an opacifying substance, such as carbon or a pH-indicator dye which is discharged into the film unit between a dimensionally stable support or cover sheet and the photosensitive element.

In certain embodiments, the cover sheet can be superposed or is adapted to be superposed on the photosensitive element. The image receiving layer can be located on the cover sheet so that it becomes an image receiving element. In certain preferred embodiments where the image receiving layer is located in the photosensitive element, a neutralizing layer is located on the cover sheet.

Increases in maximum density can be obtained in color image transfer film units containing internally sulfur and gold sensitized emulsions of the type described by Evans U.S. Pat. No. 3,761,276, and sulfonamidonaphthol redox dye releasing compounds of the type described by Fleckenstein U.K. Pat. No. 1,405,662, by incorporation into the emulsion layers of a variety of chemical addenda generally recognized in the art as antifoggants or development inhibitors, as well as hydrolyzable precursors thereof. Many of these compounds also provide improved stabilization of sensitometric properties of liquid emulsion and of the storage life of the coated emulsion. The effects, shown in film units of the type described in Examples 40 through 42 of U.S. Pat. No. 1,405,662, are in addition to the effect of 5-methylbenzotriazole in the processing composition even when the latter is present in quantities as high as 4 grams per liter. Effective compounds in general are selected from the group consisting of (a) 1,2,3-triazoles, tetrazoles and benzotriazoles having an N–$R^1$ group in the heterocyclic ring, wherein $R^1$ represents hydrogen or an alkali-hydrolyzable group, or (b) heterocyclic mercaptans or thiones and precursors thereof, mostly having one of the formulas (XII) or (XIII):

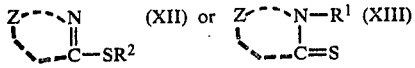

(XII) or (XIII)

wherein

Z comprises the atoms necessary to complete an azole ring, and $R^2$ represents, in addition to the groups specified above for $R^1$, a metal ion.

The compounds are generally employed at concentrations less than about 300 mg per mole of silver, each compound having an optimum concentration above which development and/or nucleation are inhibited and $D_{max}$ decreases with increasing concentration. Specifically preferred antifoggants and stabilizers, as well as other preferred color image transfer film unit and system features, are more specifically disclosed in *Research Disclosure,* Item 15162, cited above, the disclosure of which is hereby incorporated by reference.

A more detailed description of useful image transfer film units and systems is contained in the patents relating to image transfer cited above, the disclosures of which are here incorporated by reference. A specific preferred image transfer film unit and image transfer system is that disclosed by Leone et al U.S. Pat. No. 4,030,925, cited above, and here incorporated by reference.

In a specific preferred form the photographic elements of this invention are intended to produce multicolor images which can be viewed in the elements or in a receiver when the elements form a part of a multicolor image transfer system. For multicolor imaging at least three superimposed color forming layer units are coated on a support. Each of the layer units is comprised of at least one silver halide emulsion layer. At least one of the silver halide emulsion layers, preferably at least one of the silver halide emulsion layers in each color forming layer unit and most preferably each of the silver halide emulsion layers, contain an emulsion according to this invention substantially as described above. The emulsion layers of one of the layer units are primarily responsive to the blue region of the spectrum, the emulsion layers of a second of the layer units are primarily responsive to the green region of the spectrum, and the emulsion layers of a third of the layer units are primarily responsive to the red region of the spectrum. The layer units can be coated in any conventional order. In a preferred layer arrangement the red responsive layer unit is coated nearest the support and is overcoated by the green responsive layer unit, a yellow filter layer and a blue responsive layer unit. When high aspect ratio tabular grain emulsions are employed, additional preferred layer order arrangements are those disclosed in *Research Disclosure,* Vol. 225, January 1983, Item 22534. The layer units each contain in the emulsion layers or in adjacent hydrophilic colloid layers at least one image dye providing compound. Such compounds can be selected from among those described above. Incorporated dye forming couplers and redox dye releasers constitute exemplary preferred image dye providing compounds. The blue, green and red responsive layer units preferably contain yellow, magenta and cyan image dye providing compounds, respectively.

High Contrast Imaging

Relatively high contrast negative working photographic elements have been recognized to have practical photographic imaging applications. Very high contrast ($\gamma > 10$) negative working silver halide emulsions and photographic elements are commonly referred to as "lith" emulsions and photographic elements, since they are useful in forming halftone masters for plate exposures in lithography. Lith photographic elements are black-and-white photographic elements which produce silver images. By employing arylhydrazides it is possible to employ a wider range of silver halide emulsions and developers than has been traditionally possible in lith applications.

The sulfinic acid radical substituted arylhydrazides described above contemplated for use in relatively high contrast imaging are those which do not tightly adsorb to the silver halide grain surfaces. Thus, preferred sulfinic acid radical substituted arylhydrazides for relatively high contrast imaging and particularly lith imaging are those substantially free of an adsorption promoting moiety. The sulfinic acid radical substituted arylhydrazides can then be chosen from among those described above and are preferably ballasted sulfinic acid radical substituted arylhydrazides. The sulfinic acid radical substituted arylhydrazides can be employed alone or in combination with other arylhydrazides and hydrazines known to increase contrast over that attainable in the absence of such addenda, such as those disclosed in patents P-1 through P-6, cited above. The sulfinic acid radical substituted arylhydrazides allow higher speeds to be realized as compared to conventional arylhydrazides. Concentrations in the photographic elements of at least $10^{-4}$ mole per mole of silver are contemplated in the absence of adsorption promoting moieties.

The arylhydrazide compounds when present in the high contrast photographic elements of this invention are employed in a concentration of from about $10^{-4}$ to about $10^{-2}$ mole per mole of silver. A preferred quantity of the arylhydrazide compound is from $10^{-3}$ to about $10^{-2}$ mole per mole of silver. The arylhydrazide compound can be incorporated in a silver halide emulsion used in forming the photographic element. Alternatively the arylhydrazide compound can be present in a hydrophilic colloid layer of the photographic element, preferably a hydrophilic colloid layer which is coated contiguous to the emulsion layer in which the effects of the arylhydrazide compound are desired. The arylhydrazide compound can, of course, be present in the photographic element distributed between or among emulsion and hydrophilic colloid layers, such as undercoating layers, interlayers and overcoating layers.

The arylhydrazide compounds are employed in combination with negative working photographic emulsions comprised of radiation sensitive silver halide grains capable of forming a surface latent image and a vehicle. The silver halide emulsions include the high chloride emulsions conventionally employed in forming lith photographic elements as well as silver bromide and silver bromoiodide emulsions, whch are recognized in the art to be capable of attaining higher photographic speeds. Generally the iodide content of the silver halide emulsions is less than about 10 mole percent silver iodide, based on total silver halide.

The silver halide grains of the emulsions are capable of forming a surface latent image, as opposed to being of the internal latent image forming type. Surface latent image silver halide grains are employed in the overwhelming majority of negative working silver halide emulsions, whereas internal latent image forming silver halide grains, though capable of forming a negative image when developed in an internal developer, are usually employed with surface developers to form direct positive images. The distinction between surface latent image and internal latent image silver halide grains is generally well recognized in the art. Generally some additional ingredient or step is required in preparation to form silver halide grains capable of preferentially forming an internal latent image as compared to a surface latent image.

Although the difference between a negative image produced by a surface latent image emulsion and a positive image produced by an internal latent image emulsion when processed in a surface developer is a qualitative difference which is visually apparent to even the unskilled observer, a number of tests have been devised to distinguish quantitatively surface latent image forming and internal latent image forming emulsions. For example, according to one such test when the sensitivity resulting from surface development (A), described below, is greater than that resulting from internal development (B), described below, the emulsion being previously light exposed for a period of from 1 to 0.01 second, the emulsion is of a type which is "capable of forming a surface latent image" or, more succinctly, it is a surface latent image emulsion. The sensitivity is defined by the following equation:

$$S = 100/Eh$$

in which S represents the sensitivity and Eh represents the quantity of exposure necessary to obtain a mean density—i.e., $\frac{1}{2}$ (D-max + D-min).

Surface Development (A)

The emulsion is processed at 20° C. for 10 minutes in a developer solution of the following composition:

| | |
|---|---|
| N—methyl-p-aminophenol hemisulfate | 2.5 g |
| Ascorbic acid | 10 g |
| Sodium metaborate (with 4 molecules of water) | 35 g |
| Potassium bromide | 1 g |
| Water to bring the total to | 1 liter. |

Internal Development (B)

The emulsion is processed at about 20° C. for 10 minutes in a bleaching solution containing 3 g of potassium ferricyanide per liter and 0.0125 g of phenosafranine per liter and washed with water for 10 minutes and developed at 20° C. for 10 minutes in a developer solution having the following composition:

| | |
|---|---|
| N—methyl-p-aminophenol hemisulfate | 2.5 g |
| Ascorbic acid | 10 g |
| Sodium metaborate (with 4 molecules of water) | 35 g |
| Potassium bromide | 1 g |
| Sodium thiosulfate | 3 g |
| Water to bring the total to | 1 liter. |

The silver halide grains, when the emulsions are used for lith applications, have a mean grain size of not larger than about 0.7 micron, preferably about 0.4 micron or less. Mean grain size is well understood by those skilled in the art, as illustrated by Mees and James, *The Theory of the Photographic Process,* 3rd Ed., MacMillan 1966, Chapter 1, pages 36–43. The photographic emulsions of this invention are capable of producing higher photographic speeds than would be expected from their mean grain sizes. The photographic emulsions can be coated to provide emulsion layers in the photographic elements of any conventional silver coverage. Common conventional silver coating coverages fall within the range of from about 0.5 to about 10 grams per square meter.

As is generally recognized in the art, higher contrasts can be achieved by employing relatively monodispersed emulsions. The same criteria for defining monodispersity discussed above in connection with direct positive emulsions are also applicable to these emulsions.

Silver halide emulsions contain in addition to silver halide grains a vehicle. The proportion of vehicle can be widely varied, but typically is within the range of from about 20 to 250 grams per mole of silver halide. Excessive vehicle can have the effect of reducing maximum density and consequently also reducing contrast. Thus for contrast values of 10 or more it is preferred that the vehicle be present in a concentration of 250 grams per mole of silver halide or less. The specific vehicle materials are conventional, can be present in other photographic element layers, and correspond to those discussed above in connection with direct positive imaging.

Emulsions according to this invention having silver halide grains of any conventional geometric form (e.g., regular cubic or octahedral crystalline form) can be prepared by a variety of techniques—e.g., single-jet, double-jet (including continuous removal techniques), accelerated flow rate and interrupted precipitation techniques, as illustrated by Trivelli and Smith, *The Photographic Journal,* Vol. LXXIX, May, 1939, pages 330–338; T. H. James *The Theory of the Photographic Process,* 4th Ed., Macmillan, 1977, Chapter 3; Terwilliger et al *Research Disclosure,* Vol. 149, Sept. 1976, Item 14987; as well as Nietz et al U.S. Pat. No. 2,222,264; Wilgus German OLS No. 2,107,118; Lewis U.K. Pat. Nos. 1,335,925, 1,430,465 and 1,469,480; Irie et al U.S. Pat. No. 3,650,757; Morgan U.S. Pat. No. 3,917,485 (where pAg cycling is limited to permit surface development); and Musliner U.S. Pat. No. 3,790,387. Double-jet accelerated flow rate precipitation techniques are preferred for forming monodispersed emulsions. Sensitizing compounds, such as compounds of copper, thallium, cadmium, rhodium, tungsten, thorium, iridium, and mixtures thereof, can be present during precipitation of the silver halide emulsion, as illustrated by Arnold et al U.S. Pat. No. 1,195,432; Hochstetter U.S. Pat. No. 1,951,933; Overman U.S. Pat. No. 2,628,167; Mueller U.S. Pat. No. 2,950,972; Sidebotham U.S. Pat. No. 3,488,709 and Rosecrants et al U.S. Pat. No. 3,737,313. It is specifically contemplated to employ negative working surface latent image forming high aspect ratio tabular grains, such as those described in *Research Disclosure,* Item 22534, cited above; however, in view of the smaller grain diameters required for this application, tabular grain emulsions contemplated are those having at least 50 percent (preferably greater than 70 percent) of the total grain projected area accounted for by tabular grains with the tabular grains having an average aspect ratio of at least 5:1 and preferably greater than 8:1, with average tabular grain thicknesses of less than 0.5 (preferably less than 0.3) micron.

The individual reactants can be added to the reaction vessel through surface or sub-surface delivery tubes by gravity feed or by delivery apparatus for maintaining control of the pH and/or pAg of the reaction vessel contents, as illustrated by Culhane et al U.S. Pat. No. 3,821,002, Oliver U.S. Pat. No. 3,031,304 and Claes et al *Photographische Korrespondenz,* Band 102, Number 10, 1967, page 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Saito et al German OLS No. 2,556,885 and Sato et al German OLS No. 2,555,365. An enclosed reaction vessel can be employed to receive and mix reactants upstream of the main reaction vessel, as illustrated by Forster et al U.S. Pat. No. 3,897,935 and Posse et al U.S. Pat. No. 3,790,386.

The grain size distribution of the silver halide emulsions can be controlled by silver halide grain separation techniques or by blending silver halide emulsions of differing grain sizes. The emulsions can include ammoniacal emulsions, as illustrated by *Photographic Chemistry,* Vol. 1, Fountain Press, London, 1958, pages 365–368 and pages 301–304; thiocyanate ripened emulsions, as illustrated by Illingsworth U.S. Pat. No. 3,320,069; thioether ripened emulsions as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

The silver halide emulsion can be unwashed or washed to remove soluble salts. The soluble salts can be removed by chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pages 181–185; by diafiltration with a semipermeable membrane, as illustrated by *Research Disclosuren,* Vol. 102, October 1972, Item 10208, Hagemaier et al *Research Disclosure,* Vol. 131, Mar. 1975, Item 13122, Bonnet *Research Disclosure,* Vol. 135, July 1975, Item 13577, Berg et al German OLS No. 2,436,461 and Bolton U.S. Pat. No. 2,495,918 or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, Sept. 1972, Item 10152.

For high contrast photographic applications high levels of photographic speed are not necessarily required. Thus, the emulsions employed need not be chemically sensitized. Sensitization with one or more middle chalcogens, sulfur, selenium, and/or tellurium, is a preferred surface chemical sensitization. Such sensitization can be achieved by the use of active gelatin or by the addition of middle chalcogen sensitizers, such as disclosed by *Research Disclosure.* Item 17643, cited above, Section III. Reduction and other conventional chemical sensitization techniques disclosed therein which do not unacceptably reduce contrast can also be employed.

Spectral sensitization of the high contrast silver halide emulsions is not required, but can be undertaken using conventional spectral sensitizers, singly or in combination, as illustrated by *Research Disclosure,* Item 17643, cited above Section IV. For black-and-white imaging orthochromatic and panchromatic sensitizations are frequently preferred.

By suitable choice of substituent groups the dyes can be cationic, anioc or nonionic. Preferred dyes are cationic cyanine and merocyanine dyes. Emulsions containing cyanine and merocyanine dyes have been observed to exhibit relatively high contrasts. Spectral sensitizing dyes specifically preferred for use in the practice of this invention are as follows:

| | |
|---|---|
| SS-1 | Anhydro-5,5'-dichloro-9-ethyl-3,3'-bis-(3-sulfopropyl)oxacarbocyanine hydroxide, sodium salt |
| SS-2 | 5,5',6,6'-Tetrachloro-1,1',3,3'-tetraethylbenzimidazolocarbocyanine iodide |
| SS-3 | 3,3'-Diethyl-9-methylthiacarbocyanine bromide |
| SS-4 | 3,3-Diethyloxacarbocyanine iodide |
| SS-5 | 5,5'-Dichloro-3,3',9-triethylthiacarbocyanine bromide |
| SS-6 | 3,3'-Diethylthiocarbocyanine iodide |
| SS-7 | 5,5'-Dichloro-2,2'-diethylthiocarbocyanine, p-toluene sulfonate salt |
| SS-8 | 3-Carboxymethyl-5-[(3-methyl-2-thiazolidinylidene)-2-methylethylidene]rhodanine |
| SS-9 | 3-Ethyl-3-[(3-ethyl-2-thiazolidinylidene)-2-methylethylidene]rhodanine |
| SS-10 | 5-[(3-{2-Carboxyethyl}-2-thiazolidinylidene)ethylidene]-3-ethylrhodanine |
| SS-11 | 1-Carboxymethyl-5-[(3-ethyl-2-benzothiazolinylidene)ethylidene]-3-phenyl-2-thiohydantoin |
| SS-12 | 1-Carboxymethyl-5-[(1-ethyl-2(H)-naphtho-{1,2-d}thiazolin-2-ylidene)ethylidene]-3-phenyl-2-thiohydantoin |
| SS-13 | 3-Carboxymethyl-5-[(3-ethyl-2-benzothiazolinylidene)ethylidene]rhodanine |
| SS-14 | 5-[(3-Ethyl-2-benzoxazolinylidene)ethylidene]-3-heptyl-2-thio-2,4-oxazolidinedione |
| SS-15 | 3-Carboxymethyl-5-(3-ethyl-2-benzothiazolinylidene)rhodanine |
| SS-16 | 3-Carboxymethyl-5-(3-methyl-2-benzoxazolinylidene)rhodanine |
| SS-17 | 3-Ethyl-5D-[(3-ethyl-2-benzoxazolinylidene)ethylidene]rhodanine |

The photographic elements can be protected against fog by incorporation of antifoggants and stabilizers in the element itself or in the developer in which the element is to be processed. Any of the antifoggants described above in connection with direct positive images, patents P1 through P7 cited above, Mifune et al U.S. Pat. Nos. 4,241,164, 4,311,781, 4,166,742, and 4,237,214, and Okutsu et al U.S. Pat. No. 4,221,857, can be employed. The benzotriazoles described above are preferred.

The benzotriazole can be located in the emulsion layer or in any hydrophilic colloid layer of the photographic element in a concentration in the range of from $10^{-4}$ to $10^{-1}$ preferably $10^{-3}$ to $3\times10^{-2}$, mole per mole of silver. When the benzotriazole antifoggant is added to the developer, it is employed in a concentration of from $10^{-6}$ to about $10^{-1}$preferably $3\times10^{-5}$ to $3\times10^{-2}$, mole per liter of developer.

In addition to the components of the photographic emulsions and other hydrophilic colloid layers described above it is appreciated that other conventional element addenda compatible with obtaining relatively high contrast silver images can be present. For example, the photographic elements can contain developing agents (described below in connection with the processing steps), development modifiers, plasticizers and lubricants, coating aids, antistatic materials, and matting agents, these conventional materials being illustrated in *Research Disclosure,* cited above, Item 17643, Sections XII, XIII, XVI, and XX. The elements can be exposed as described in Section XVIII.

The light sensitive silver halide contained in the photographic elements can be processed following exposure to form a relatively high contrast image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York 1977; and *Neblette's Handbook of Photographic and Reprographic Materials, Processes and Systems,* VanNostrand Reinhold Company, 7th Ed., 1977.

It is a distinct advantage of the present invention that the photographic elements can be processed in conventional developers generally as opposed to specialized developers conventionally employed in conjunction with lith photographic elements to obtain very high contrast images. When the photographic elements contain incorporated developing agents, the elements can be processed in an activator, which can be identical to the developer in composition, but lacking a developing agent. Very high contrast images can be obtained at pH values in the range of from 10 to 13.0, preferably 10.5 to 12.5. It is also an advantage of this invention that relatively high contrast images can be obtained with higher concentrations of preservatives to reduce aerial oxidation of the developing agents, such as alkali sulfites (e.g., sodium or potassium sulfite, bisulfite or metasulfite) than has heretofore been feasible in traditional lith processing. This allows the developers to be stored for longer periods. Any preservative or preservative concentration conventional in lower contrast processing can be employed, such as, for instance, a sulfite ion concentration in the range of from about 0.15 to 1.2 mole per liter of developer.

The developers are typically aqueous solutions, although organic solvents, such as diethylene glycol, can also be included to facilitate the solvency of organic components. The developers contain one or a combination of conventional developing agents, such as polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Also, chelating and sequestering agents, such as ethylenediaminetetraacetic acid or its sodium salt, can be present. Generally, any conventional developer composition can be employed in the practice of this invention. Specific illustrative photographic developers are disclosed in the *Handbook of Chemistry and Physics,* 36th Edition, under the title "Photographic Formulae" at page 3001 et seq., and in *Processing Chemicals and Formulas,* 6th Edition, published by Eastman Kodak Company (1963), the disclosures of which are here incorporated by reference. The photographic elements can, of course, be processed with conventional developers for lith photographic elements, as illustrated by Masseth U.S. Pat. No. 3,573,914 and VanReusel U.K. Pat. No. 1,376,600.

Less Than High Contrast Imaging

The sulfinic acid radical substituted arylhydrazides are capable of increasing the speed of negative working silver halide emulsions without also producing high contrast levels, as described above. Thus, the invention is capable of increasing the speed of negative working emulsions over the full range of useful contrast levels. Further, the sulfinic acid radical substituted arylhydrazides are useful in relatively high speed negative working silver halide emulsions which are not generally suitable for producing very high contrast levels, such as conventional larger grain size and/or gold surface sensitized negative working silver halide emulsions. For this application the sulfinic acid radical substitute arylhydrazides are those that contain adsorption promoting moiety. A specifically preferred adsorption promoting moiety is that described by formula VI. The sulfinic acid radical substituted arylhydrazide is incorporated directly in the silver halide emulsion, rather than being in a separate layer of the photographic element. To avoid elevated levels of minimum density the arylhydrazide is incorporated in a concentration of less than $10^{-2}$ mole per mole of silver. Although any effective amount can be employed, concentrations of at least about $10^{-7}$ mole per silver mole are specifically contemplated, with a range of from about $10^{-6}$ to $10^{-4}$ mole per mole of silver being preferred.

The silver halide grains, being surface latent image forming, can be identical to those emloyed in relatively high contrast imaging described above. However, whereas preferred lith emulsions employ grain sizes of less than about 0.7 micron in average diameter, the full range of photographically useful silver halide grain sizes are contemplated, including coarse as well as medium and fine grain emulsions. Since it is recognized that photographic speeds generally increase with increasing grain sizes, average grain sizes in excess of 0.7 micron are generally preferred for the higher speed imaging applications. Silver bromoiodide emulsions are generally faster than other silver halides at comparable levels of granularity and are therefore particularly preferred for this application of the invention.

Particularly preferred emulsions are high aspect ratio tabular grain emulsions, such as those described in *Research Disclosure,* Item 22534, cited above. Most specifically preferred are high aspect ratio tabular grain silver bromoiodide emulsions also described in Wilgus et al U.S. Ser. No. 429,420 now U.S. Pat. No. 4,434,226, Kofron et al U.S. Ser. No. 429,407 now U.S. Pat. No. 4,439,520, and Solberg et al U.S. Ser. No. 431,913 now U.S. Pat. No. 4,433,048, each filed Sept. 30, 1982, each commonly assigned, and each here incorporated by reference. High aspect ratio tabular grain emulsions are those in which the tabular grains having a diameter of at least 0.6 micron and a thickness of less than 0.5 micron (preferably less than 0.3 micron) have an average aspect ratio of greater than 8:1 (preferably at least 12:1) and account for greater than 50 percent (preferably greater than 70 percent) of the total projected area of the silver halide grains present in the emulsion.

These silver halide emulsions employed to obtain increased photographic imaging speeds can contain vehicles identical to those described above for direct positive and high contrast imaging. Conventional proportions of vehicle to silver halide are employed.

Surface gold sensitization of the emulsions can be undertaken by conventional techniques. For example, gold sensitization can be undertaken as taught by Damshroder et al. U.S. Pat. No. 2,642,361. Combinations of gold sensitization with middle chalcogen sensitization (i.e., sulfur, selenium, and/or tellurium) sensitization, the latter being described above in connection with high contrast imaging, or reduction sensitization are specifically contemplated. Conventional chemical sensitizations of these types as well as noble metal sensitizations generally are illustrated by *Research Disclosure,* Item 17643, cited above, Section III, here incorporated by reference. Generally the highest photographic speeds are achieved with sulfur and gold sensitized silver bromoiodide emulsions, such as taught by Illingsworth U.S. Pat. No. 3,320,069. Kofron et al., cited above, discloses substantially optimum chemical and spectral spectral sensitizations for high aspect ratio tabular grain silver halide emulsions, particularly silver bromide and silver bromoiodide emulsions.

In their simplest form photographic elements useful in obtaining increased imaging speed need only contain a single layer of an emulsion as described coated on a conventional photographic support. Apart from the requirement of at least one silver halide emulsion layer as described above, the photographic elements can take any convenient conventional form. The photographic elements can produce either silver or dye (including multicolor dye) images. When employed to form silver images, the photographic elements can be similar to those employed to produce high contrast images, subject to preferred differences specifically described above. When employed to form dye images, the photographic elements can be similar to the photographic elements described above in connection with direct positive imaging, except that negative working surface latent image forming emulsion is substituted for the internal latent image forming emulsion.

The photographic elements can be used to form either retained or transferred images. When employed to form transferred dye images, the image transfer film units can be similar to those described above in connection with direct positive imaging. However, the high speed negative working emulsion or emulsions are substituted for the direct positive emulsion or emulsions present and therefore positive working transferred dye image providing chemistry will usually be desirably substituted for negative working transferred dye image providing chemistry to provide a positive transferred image. Such modifications are, of course, well within the skill of the art. For image transfer systems useful with the negative working surface latent image forming emulsions, attention is directed to *Research Disclosure,* Item 17643, cited above, Section XXIII, here incorporated by reference.

The increased speed advantages of this invention can be realized employing conventional exposure and processing. Exposure and processing of the photographic elements can be identical to that previously described in connection with direct positive and high contrast imaging, although this is not essential. The same pH ranges as described above are generally preferred for processing the increased speed photographic elements.

Antifoggants and stabilizers can be present in the photographic element and/or in the processing solution. Although the antifoggants and stabilizers preferred in connection with direct positive and high contrast imaging can be advantageously employed, the use of conventional antifoggants and stabilizers generally is specifically contemplated. Useful antifoggants and stabilizers are specifically disclosed by *Research Disclosure.* Item 17643, cited above, Section VI, here incorporated by reference.

Except as otherwise stated the remaining features of the direct positive, high contrast, and increased speed applications of the invention should be understood to contain features recognized in the art for such photographic applications.

EXAMPLES

The invention can be better appreciated by reference to following specific examples:

EXAMPLE 1

This Example demonstrates the preparation of SA-1, 1-(4-aminophenyl)-2-formyl-2-(4-methylphenylsulfonyl)hydrazine.

1-Formyl-2-(4-nitrophenyl)hydrazine (0.05 mole) was suspended in ethanol (~200 ml) and hydrogenated (10% Pd/C, $H_2$/40 psi). After removing the catalyst by filtration, the filtrate was treated with a solution of sodium p-toluenesulfinate (0.2 mole) in water (200 ml) and combined rapidly with an aqueous solution (100 ml) of potassium ferricyanide (0.1 mole). The resulting red solution decolorized when a precipitate formed. An aqueous solution (11) of sodium bicarbonate (0.05 mole) was added which caused the formation of a yellow solid. This solid was washed with water and air dried; yield 11.7 g (77%), m.p. 148°-149° C. dec; $^1$H NMR (DMSO-$d_6$) δ10.60 and 10.32 (b, 1H, NH) (δ8.25 (d) and δ7.92 (s, combined 1H, CHO) δ7.50 (s, 4H) δ6.92 (d, 2H) δ6.47 (d, 2H δ5.25 (bs, 2H, $NH_2$) δ2.45 (s, 3H); IR (KBr) 3500, 3400, 1720, 1360 and 1180 $cm^{-1}$; mass spectrum M/e 305 (M+).

Anal. for: $C_{14}H_{15}N_3O_3S$: Calcd.: C, 55.1; H, 5.0; N, 13.8. Found: C, 55.3; H, 5.0; N, 13.7.

Example 2

This Example demonstrates the synthesis of SA-2, 1-{4-[2-(2,4-bis-t-amylphenoxy)butanamido]phenyl}-2-formyl-2-(4-methylphenylsulfonyl)hydrazine.

1-(4-Aminophenyl)-2-formyl-2-(4-methylphenylsulfonyl)hydrazine (SA-1) (6.1 g, 0.02 mole) and pyridine (2.0 ml) were added to an anhydrous tetrahydrofuran (150 ml) solution of 2-(2,4-bis-t-amylphenoxy)butanoyl chloride (7.0 g, 0.21 mole). After stirring for 30 minutes at room temperature, the reaction mixture was filtered and concentrated to a brown oil. The oil was dissolved in ether, decolorized with charcoal and concentrated to a yellow solid. A hot hexane extraction of the yellow solid was concentrated and chilled to give a waxy solid; yield 5.0 g (41%), m.p. 81°-95° C.; :$^1$H NMR ($CDCl_3$) δ9.60 and δ9.50 (combined 1H) δ8.30 (d) and δ8.07 (s, combined 1H CHO) δ7.65-6.50 (m, 12H) δ4.70 (t, 1H) δ2.50 (s, 3H) 2.30-0.50 (bm, 27H); IR (KBr) 2980, 1717, 1520, 1380 and 1180 $cm^{-1}$; mass spectrum M/e 607 (M+).

Anal. for: $C_{34}H_{45}N_3O_5S$: Calcd.: C, 67.2; H, 7.5; N, 6.9. Found: C, 67.0; H, 7.8; N, 6.6.

Example 3

Control C

A coarse grain sulfur and gold sensitized silver bromoiodide x-ray emulsion was combined with 2-methyl-2,4-pentanediol, gelatin, saponin, 4-hydroxy-6-methyl-1,3,3a,7-tetraazaindene, anhydro-5-chloro-9-ethyl-5'-phenyl-3'-(3-sulfobutyl-3-(3-sulfopr opyl)oxacarbocyanine hydroxide, sodium salt and coated on a film support at 4.3 g Ag/$m^2$ and 4.8 g gel/$m^2$. The dried coating was exposed for 1/50 second to simulated blue screen light and processed for 3 minutes in an Elon ®(N-methylp-aminophenol hemisulfate)-hydroquinone developer at 20° C. The sensitometric results are listed in Table II.

Example Coating

The example coating differed from the Control Coating in also containing the tosylated acyl hydrazide SA-3, 1-formyl-2-(4-methylphenylsulfonyl)-2-[4-(3-methyl-2-thioureido)phenyl]hydrazine, at $0.38\times10^{-6}$ mole/mole Ag. The coating was exposed and processed as described in Example 3. The results are listed in Table II.

EXAMPLE 4

Example 4 differs from the Control Coating of Example 3 in containing $3.8\times10^{-6}$ moles/mole Ag of the tosylated hydrazide, SA-4, 1-formyl-2-(4-methylphenylsulfonyl)-2-[4-(3-phenylureido)phenyl]hydrazine. The results are listed in Table II.

TABLE II

| Example | Compound | μmole/mole Ag | Rel. Speed* | D-min |
|---|---|---|---|---|
| 3 | None | — | 100 | 0.06 |
| 3 | SA-3 | 0.38 | 118 | 0.08 |
| 4 | SA-4 | 3.8 | 107 | 0.06 |

*Measured at 0.3 above D-min.

EXAMPLES 5-9

A series of hydrazides and their tosylated derivatives were tested as nucleating agents (1.104 mmoles/mole Ag) in a direct positive internal image silver bromide emulsion. The emulsion was coated at 6.46 g Ag/m$^2$ and 4.84 g gel/m$^2$ on a film support, given a $10^{-5}$ second EG&G sensitometer exposure (simulated P11 phosphor) and processed for 2 minutes at 37.8° C. in a hydroquinone developer. Table III lists the compounds and their sensitometric results.

TABLE III

| Example | Structure | Compound | D-max | D-min |
|---|---|---|---|---|
| C-1 | $C_6H_5NHNHCOC_6H_5$ | C-1 | 1.5 | 0.08 |
| 5 | $C_6H_5NNHCOC_6H_5$ (Ts) | (SA-5) | 2.5 | 0.07 |
| 6 | $C_6H_5NH—N(Ts)—COC_6H_5$ | (SA-6) | 3.1 | 0.07 |
| C-2 | $C_6H_5NHNHCOC(CH_3)_3$ (O) | C-2 | 1.8 | 0.08 |
| 7 | $C_6H_5NH—N(Ts)—COC(CH_3)_3$ | (SA-7) | 3.5 | 0.08 |
| C-3 | $C_6H_5NHNHCOCH_3$ | C-3 | 1.5 | 0.07 |
| 8 | $C_6H_5NH—N(Ts)—COCH_3$ | (SA-8) | 3.4 | 0.08 |
| C-4 | $C_6H_5NHNHCO_2C_2H_5$ | C-4 | 1.7 | 0.08 |

TABLE III-continued

| Example | Structure | Compound | D-max | D-min |
|---|---|---|---|---|
| 9 | $C_6H_5NH—N(Ts)—CO_2C_2H_5$ | (SA-9) | 2.1 | 0.08 |

Ts = $CH_3$— 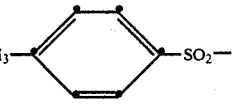 —$SO_2$—

EXAMPLES 10–13

These Examples demonstrate the use of tosylated hydrazides with formyl blocking groups as nucleating agents (1.104 mmoles/mole Ag) in the same emulsion as described in Examples 5–19. The results are given in Table IV.

TABLE IV

| Example | Structure | Compound | D-max | D-min |
|---|---|---|---|---|
| C-5 | HO— 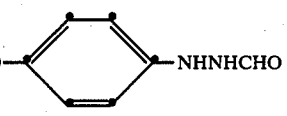 —NHNHCHO | (C-5) | 2.0 | 0.07 |
| 10 | HO— 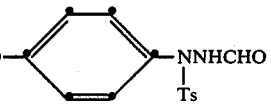 —NNHCHO (Ts) | (SA-10) | 2.6 | 0.08 |
| 11 | $CH_3CO_2$— 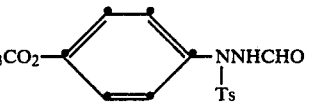 —NNHCHO (Ts) | (SA-11) | 1.6 | 0.06 |
| 12 | $C_5H_{11}CO_2$— 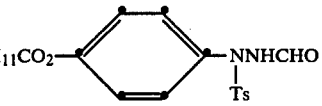 —NNHCHO (Ts) | (SA-12) | 0.7 | 0.05 |
| 13 | 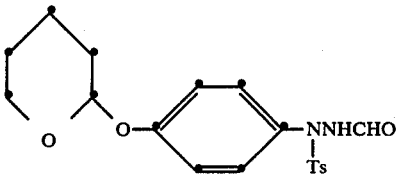 | (SA-13) | 2.6 | 0.07 |

*$10^{-5}$ EG & G sensitometer exposure (simulated P11 phosphor). Process for 30 sec/37.8° C. in hydroquinone developer (pH 10.7).

Ts = $CH_3$— 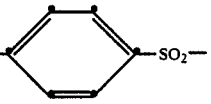 —$SO_2$—

EXAMPLE 14

Control Coating

This is a control coating involving a lith material. A 0.20 to 0.25 μm cubic grain silver bromoiodide emulsion (97.5/1.5) containing the compound C-6, 1-formyl-2-[4-(3-hexylureido)phenyl]hydrazine, at 2.15 mmoles/mole Ag was coated at 4.30 g Ag/m$^2$ and 2.64 g gel/m$^2$ on a film support:

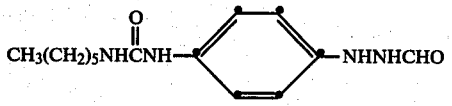

(C-6)

The dried coating was exposed (1 second, 500 W, 3000° K.) through a graduated density step wedge and processed for 90 sec at 32.2° C. in a (1-phenyl-3-pyrazolidone)-hydroquinone developer. The sensitometric results are listed in Table V.

Example Coating

This coating differs from the Control Coating in containing 2.15 mmole/mole Ag of the tosylated derivative of the C-6, SA-14, 1-formyl-2-[4-(3-hexylureidophenyl)]-2-(4-methylphenylsulfonyl)hydrazine. The coating was exposed and processed identically as the control coating. The data are shown in Table V.

TABLE V

| | Rel. Speed* | D-min | D-max | Gamma |
|---|---|---|---|---|
| C-6 | 100 | 0.30 | 3.97 | 35.53 |
| SA-14 | 123 | 0.40 | 3.91 | 14.44 |

*Relative speed measured at 0.20 above D-min.

When no arylhydrazide is present the gamma is well below 10.

Preparation of SA-15, 1-formyl-2-(4-methylphenylsulfonyl)-2-[4-(phenoxythiocarbonylamino)phenyl]hydrazine 1-(4-Aminophenyl)-2-formyl-1-(4-methylphenylsulfonylhydrazine (1.5 g, 4.9 mmole), phenylthiochloroformate (0.85 g, 4.8 mmole), and pyridine (0.40 g, 5.0 mmole) were combined, heated briefly and filtered. The filtrate was stirred for 2 hrs. at room temperature and concentrated by evaporation. The residue was purified by column chromatography on silica gel. Elution with methylene chloride removed the impurities; subsequent elution with ether gave an eluate from which the product crystallized. The solid was collected by filtration and dried; yield 1.0 g (40 percent) m.p. 195°-196° C.

Anal. for: $C_{21}H_{19}N_3O_4S_2$: Calcd.: C, 57.1; H, 4.3; N, 9.5. Found: C, 57.6, H, 4.6; N, 9.3.

Preparation of SA-16, 1-(4-ethoxythiocarbonylaminophenyl)-2-formyl-1-(4-methylphenylsulfonyl)-hydrazine 1-(4-Aminophenyl)-2-formyl-1-(4-methylphenylsulfonyl)hydrazine (2.0 g, 6.5 mmole) was added to dry acetonitrile (50 ml) under nitrogen with stirring and cooled in an ice bath. Thiocarbonyldiimidazole (1.4 g, 7.8 mmole) was added in portions as a solid. The reaction mixture was stirred for 30 minutes at ice bath temperatures and then for 1 hour at room temperature. After concentrating the reaction mixture by evaporation, the oily residue was slurried with water. After decanting the water, the oil was dissolved in ethanol (50 ml) and refluxed for approximately 15 hours. The solvent was evaporated and the residue was purified by column chromatography on silica gel. Elution with methylene chloride removed the by-products. Subsequent elution with ether gave a product which crystallized out of the ether fractions. This solid was collected by filtration and dried; yield 0.32 g (12 percent), m.p. 179.5°-180.5° C.

Anal. for: $C_{17}H_{19}N_3O_4S_2$: Calcd. C, 51.9; H, 4.9; N, 10.7. Found: C, 52.3; H, 5.1; N, 10.7.

Example 15

Control Coating

A 0.75 μm, octahedral, core/shell silver bromide emulsion internally sensitized with sulfur plus gold and surface sensitized with sulfur was coated on a film support at 4.09 g Ag/m$^2$ and 5.81 g gel/m$^2$ with a gelatin overcoat layer (0.65 g/m$^2$) as a control coating. The dried coating was exposed for 2 sec/500W 5500° K. through a graduated den step wedge and processed (30 sec at 21.1° C.) in a hydroquinone phenidone ® (1-phenyl-3-pyrazolidone) developer.

Example Coating

This coating was like the control coating, but also contained SA-16 at 0.15 mmole/mole Ag. The results are in Table VI

TABLE VI

| Compound | Reversal D-max | Reversal D-min |
|---|---|---|
| None | 0.07 | 0.06 |
| SA-16 | 2.02 | 0.07 |

EXAMPLE 16

This example demonstrates the use of SA-3 as a nucleating agent for a tabular grain emulsion.

Control Coating

A polydisperse tabular grain (5.5 μm×0.12 μm) silver bromide core/shell emulsion, internally sensitized with sulfur plus gold and no intentional surface sensitization was coated on a film support at 2.15 g Ag/m$^2$ and 10.3 g gel/m$^2$. The coating was sensitized spectrally with anhydro-5-chloro-9-ethyl-5'-phenyl-3'-(3-sulfobutyl)-3-(3-sulfopropyl)oxacarbocyanine hydroxide, sodium salt (418 mg/mole Ag) and anhydro-11-ethyl-1,1'-bis-(3-sulfopropyl)naphthyl[1,2-d]oxazolocarbocyanine hydroxide, sodium salt (120 mg/mole Ag). The dried coating was exposed (1/10 sec/500W, 5500° K., Wratten 12 filter) through a continuous step wedge and processed (6 min/20° C.) in a hydroquinone Metol ®. (N-methyl-p-aminophenol hemisulfate) developer. The sensitometric data are in Table VII.

Example Coating

This coating was like the Control Coating, but also contained SA-3 at 0.198 mmole/mole Ag. The results are in Table VII

TABLE VII

| Compound | Reversal D-max | Reversal D-min |
|---|---|---|
| None | 0.05 | 0.14 |
| SA-3 | 1.44 | 0.23 |

Similar results were obtained at concentrations ranging from about $5.3\times10^{-6}$ to about $5.3\times10^{-4}$ mole cpd/mole Ag.

EXAMPLE 17

This Example demonstrates the pH response of SA-3. The control emulsion described in Example 15 was coated on a film support at 5.81 g Ag/m$^2$ and 9.69 g gel/m$^2$ with a gelatin overcoat layer (1.07 g/m$^2$). The coating also contained SA-3 at 0.13 mmole/mole Ag.

Samples of this coating were exposed (1/100 sec, EG&G sensitometer, Wratten 47B filter) through a graduated step wedge and processed (4 min at 21.1° C.) in a N-methyl-p-aminophenol hemisulfate-hydroquinone developer at differing pH. The results are shown below in Table VIII.

TABLE VIII

| pH | Reversal D-max | Reversal D-min |
|---|---|---|
| 10.1 | 0.63 | 0.08 |
| 10.5 | 1.78 | 0.09 |
| 11.0 | 2.52 | 0.12 |
| 11.5 | 3.26 | 0.17 |
| 12.0 | 1.92 | 0.14 |
| 12.5 | 0.57 | 0.18 |
| 13.0 | 0.42 | 0.32 |

The preferred pH range was demonstrated to be 10.5 to 12.5.

EXAMPLE 18

A 0.75 μm octahedral grain silver bromide emulsion internally sensitized with sulfur plus gold and surface sensitized with sulfur was coated on a clear acetate film support at 4.09 g Ag/m$^2$ and 5.81g gel/m$^2$ with a 0.65g gel/m$^2$ overcoat layer. 1-(4-Ethoxythiocarbonylaminophenyl)-2-formyl-1-(4-methylphenylsulfonyl)hydrazine (SA-16) was incorporated into the emulsion layer at 0.063 mmole/mole Ag. An identical coating was prepared, but with C-7, 1-(4-ethoxythiocarbonylaminophenyl)2-formylhydrazine, substituted for SA-16. The dried coatings were exposed (500W, 5500° K.) for 2 seconds through a graduated density step wedge and processed for 30 seconds in a Phenidone®(1-phenyl-3-pyra-zolidone)-hydroquinone developer at pH 13.2. The sensitometric curves are shown in FIG. 1. Note the higher D-min and rereversal of the image when the non-tosylated hydrazide (C-7) is incorporated in the coating.

EXAMPLE 19

Figure 2:
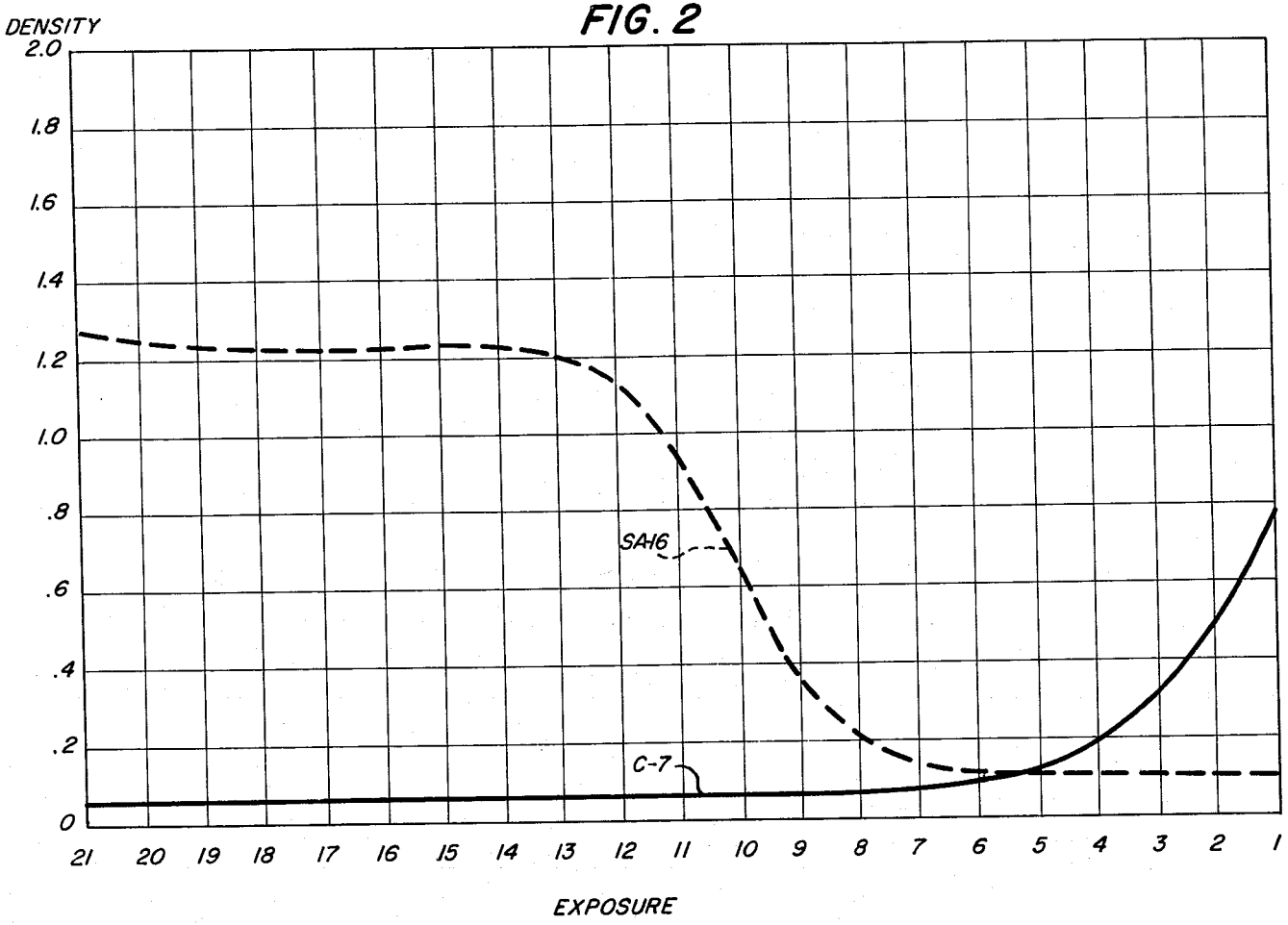

A second set of coatings was exposed in the same manner and processed for 15 minutes in an Elon® (N-methyl-p-methylaminophenol hemisulfate)ascorbic acid developer at a much lower pH, i.e., at pH 9.8. The sensitometric curves are shown in FIG. 2. Note the complete lack of reversal image with the non-tosylated hydrazide at this lower pH and the good reversal developability (D-max 1.24; D-min 0.10) of the coating containing a tosylated hydrazide.

The invention has been described in detail with particular reference to preferred embodiments thereof, but it will be understood that variations and modifications can be effected within the spirit and scope of the invention.

What is claimed is:

1. A radiation sensitive silver halide emulsion containing an arylhydrazide comprised of an acyl group linked to a ring carbon atom of an aryl group by a hydrazo moiety having one of its nitrogen atoms sulfinic acid radical substituted and a hydrogen atom bonded to the other of its nitrogen atoms, said sulfinic acid radical substituent being of the formula:

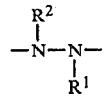

where Ar$^1$ is an aromatic group.

2. A radiation sensitive silver halide emulsion according to claim 1 in which said hydrazo moiety is of the following formula:

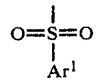

wherein

R$^1$ is hydrogen or said sulfinic acid radical substituent and

R$^2$ is said sulfinic acid radical substituent when R$^1$ is hydrogen and hydrogen when R$^1$ is said sulfinic acid radical substituent.

3. A radiation sensitive silver halide emulsion according to claim 2 containing surface latent image forming silver halide grains.

4. A radiation sensitive silver halide emulsion according to claim 2 containing internal latent image forming silver halide grains.

5. A radiation sensitive silver halide emulsion according to claim 1 in which said arylhydrazide is present in a concentration of up to $10^{-2}$ mole per mole of silver.

6. A radiation sensitive silver halide emulsion according to claim 1 in which Ar$^1$ is a carbocyclic aromatic ring.

7. A radiation sensitive silver halide emulsion according to claim 6 in which Ar$^1$ is a phenyl substituent.

8. A radiation sensitive silver halide emulsion according to claim 7 in which said phenyl substituent is alkyl substituted.

9. A radiation sensitive silver halide emulsion according to claim 1 in which said arylhydrazide includes a moiety for promoting adsorption to silver halide grain surfaces.

10. A radiation sensitive silver halide emulsion according to claim 1 in which said arylhydrazide is of the formula:

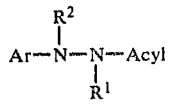

wherein

Acyl is an acyl group;

Ar is a aryl group; and

R$^1$ is hydrogen; and

R$^2$ is said sulfinic acid radical substituent.

11. In a photographic element comprised of a support a radiation sensitive silver halide emulsion, the improvement in which said silver halide emulsion is comprised of an emulsion according to any one of claims 1 through 10.

12. In a photographic element capable of producing a direct positive image comprised of a support, an emulsion comprised of a dispersing medium and internal latent image forming silver halide grains, and up to $10^{-2}$ mole per mole of silver of an arylhydrazide nucleating agent capable of selectively rendering unexposed silver halide grains developable in a surface developer comprised of an acyl group linked to a ring carbon atom of an aryl group by a hydrazo moiety, the improvement comprising said hydrazo moiety containing an activating sulfinic acid radical substituent of the formula:

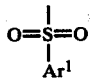

where $Ar^1$ is an aryl group.

13. A photographic element according to claim 12 in which said arylhydrazide is of the formula:

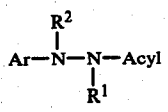

wherein

Acyl is an acyl group;

Ar is an aryl group; and $R^1$ is said sulfinic acid radical substituent.

14. A photographic element according to claim 13 in which Ar' is a phenyl substituent.

15. A photographic element according to claim 14 in which said phenyl substituent is alkylphenyl, wherein said alkyl moiety contains 1 to 3 carbon atoms.

16. A photographic element according to claim 12 in which said arylhydrazide includes a thioamide adsorption promoting moiety and is adsorbed to the surface of the said silver halide grains in a concentration of from $10^{-5}$ to $10^{-3}$ mole per mole of silver.

17. A photographic element according to claim 13 which said Ar includes an adsorption promoting moiety of the formula:

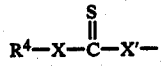

wherein one of X and X' represents —N($R^5$)— and the other represents —O—, —S—, or —N($R^6$)—;

$R^4$ represents hydrogen, an aliphatic residue, an aromatic residue, or together with X or X' completes a heterocyclic ring;

$R^5$ or $R^6$ in the X position represents hydrogen, an aliphatic residue, or an aromatic residue; and $R^5$ or $R^6$ in the X' position represents hydrogen or a benzyl substituent;

provided that at least one of $R^4$, $R^5$, and $R^6$ must be hydrogen when each is present.

18. In a black and white silver image forming direct positive photographic element comprised of a support and a silver halide emulsion layer, the improvement comprising said silver halide emulsion layer being comprised of an emulsion according to claim 4.

19. In a photographic image transfer film unit comprising a support, an emulsion layer, a dye image providing material capable of shifting between a mobile and an immobile form as a function of silver halide development, and a receiving layer for providing a viewable transferred dye image following exposure and processing of said emulsion layer, the improvement in which said emulsion layer is comprised of an emulsion according to claim 4.

20. In a negative working photographic element capable of producing a high contrast silver image comprised of a support, a silver halide emulsion layer comprised of a dispersing medium and radiati on sensitive silver halide grains capable of forming a surface latent image having a mean diameter of 0.7 micron or less, and in said emulsion layer or an adjacent hydrophilic colloid layer an arylhydrazide in a concentration of from $10^{-4}$ to $10^{-2}$ mole per mole of silver, said arylhydrazide having an acyl group linked to a ring carbon atom of an aryl group by a hydrazo moiety, the improvement comprising said hydrazo moiety containing an activating sulfinic acid radical substituent of the formula:

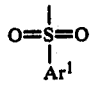

where $Ar^1$ is an aryl group.

21. A photographic element according to claim 20 in which said dispersing medium is present in a concentration of 250 grams or less per mole of silver.

22. A photographic element according to claim 21 in which said photographic element contains a fog reducing and contrast enhancing amount of a benzotriazole.

23. A photographic element according to claim 20 in which said arylhyrazide is of the following formula:

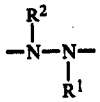

wherein $R^1$ is hydrogen or said sulfinic acid radical substituent; and $R^2$ is said sulfinic acid radical substituent when $R^1$ is hydrogen or hydrogen when $R^1$ is said sulfinic acid radical substituent.

24. A photographic element according to claim 23 in which said arylhydrazide is ballasted.

25. A photographic element according to claim 23 in which said arylhydrazide is the formula:

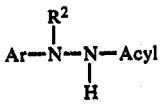

wherein

Acyl is an acyl group;

Ar is an aryl group; and $R^2$ is said sulfinic acid radical substituent.

26. A photographic element according to claim 25 in which said phenyl substituent is alkylphenyl, said alkyl moiety having from 1 to 3 carbon atoms.

27. In a negative working silver halide photographic element comprised of a support, an emulsion layer comprised of a dispersing medium, surface latent image forming silver halide grains, and adsorbed to the surface of said silver halide grains from $10^{-7}$ to $10^{-2}$ mole per mole of silver of an arylhydrazide comprised of a thioamide adsorption promoting moiety substituted aryl group linked directly at a ring carbon atom to a hydrazo group which in turn is directly linked to an acyl group, the improvement comprising said hydrazo moiety containing an activating sulfinic acid radical substituent of the formula:

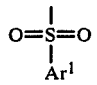

where $Ar^1$ is an aryl group.

28. A negative working silver halide photographic element according to claim 27 in which said silver halide grains are gold sensitized.

29. A negative working silver halide photographic element according to claim 28 in which said silver halide grains are additionally sulfur sensitized.

30. A negative working silver halide photographic element according to claim 27 in which said arylhydrazide is present in a concentration of from $10^{-6}$ to $10^{-4}$ mole per mole of silver.

31. In a negative working silver halide photographic element comprised of a support, an emulsion layer comprised of a dispersing medium, surface latent image forming silver halide grains, and adsorbed to the surfaces of said silver halide grains from $10^{-7}$ to $10^{-2}$ mole per mole of silver of an arylhydrazide comprised of a thioamide adsorption promoting moiety substituted aryl group, an acyl group, and a divalent hydrazo moiety linking a ring carbon atom of said aryl to said acyl groups, the improvement in which said arylhydrazide is of the formula:

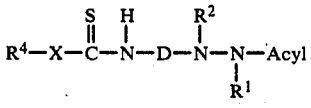

wherein

Acyl is an acyl group;

D is phenylene;

$R^1$ is hydrogen;

$R^2$ is a sulfinic acid radical substituent;

X is —0—, —S—, or —N($R^6$)—; and $R^4$ and $R^6$ are hydrogen, alkyl, haloalkyl, alkoxyalkyl, phenylalkyl, phenyl, naphthyl, alkylphenyl, cyanophenyl, halophenyl, or alkoxyphenyl, each alkyl moiety having up to about 18 carbon atoms.

32. A photographic element according to claim 31 in which said sulfinic acid radical substituent is of the formula:

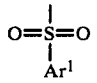

where Ar' is a phenyl substituent.

33. A photographic element according to claim 33 in which said phenyl substituent is an alkylphenyl subsitutent in which said alkyl moiety contains from 1 to 3 carbon atoms.

34. A silver halide photographic light sensitive material comprising a layer containing a compound represented by the formula

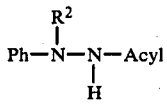

wherein

Acyl represents an acyl group;

Ph represents a substituted or unsubstituted phenyl group; and $R^2$ represents a sulfinic acid radical of the formula:

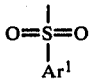

where $Ar^1$ is an aryl group.

* * * * *